US008986131B2

(12) United States Patent
Stites et al.

(10) Patent No.: US 8,986,131 B2
(45) Date of Patent: Mar. 24, 2015

(54) GOLF CLUB HEAD AND GOLF CLUB WITH AERODYNAMIC FEATURES

(75) Inventors: John T. Stites, Weatherford, TX (US); Robert Boyd, Flower Mound, TX (US); Raymond J. Sander, Benbrook, TX (US); Eric A. Larson, Arlington, TX (US)

(73) Assignee: Nike, Inc., Beaverton, OR (US)

( * ) Notice: Subject to any disclaimer, the term of this patent is extended or adjusted under 35 U.S.C. 154(b) by 200 days.

(21) Appl. No.: 13/484,981

(22) Filed: May 31, 2012

(65) Prior Publication Data

US 2013/0324293 A1 Dec. 5, 2013

(51) Int. Cl.
*A63B 53/04* (2006.01)

(52) U.S. Cl.
CPC ..... *A63B 53/0466* (2013.01); *A63B 2053/0408* (2013.01); *A63B 2053/0433* (2013.01); *A63B 2053/0437* (2013.01); *A63B 2225/01* (2013.01)
USPC ..... 473/327; 473/345; 473/349

(58) Field of Classification Search
CPC ..... A63B 2053/0437; A63B 53/04; A63B 53/0466; A63B 2053/0408; A63B 2053/0412
USPC ..... 473/324–350, 287–292
See application file for complete search history.

(56) References Cited

U.S. PATENT DOCUMENTS

| | | | | | |
|---|---|---|---|---|---|
| 4,077,633 | A * | 3/1978 | Studen | 473/251 |
| 5,092,599 | A * | 3/1992 | Okumoto et al. | 473/327 |
| 5,221,086 | A * | 6/1993 | Antonious | 473/327 |
| 5,511,786 | A * | 4/1996 | Antonious | 473/327 |
| 5,766,095 | A * | 6/1998 | Antonious | 473/345 |
| D447,783 | S * | 9/2001 | Glod | D21/752 |
| 6,530,847 | B1 * | 3/2003 | Antonious | 473/327 |
| 7,156,750 | B2 * | 1/2007 | Nishitani et al. | 473/329 |
| 7,789,774 | B2 * | 9/2010 | Rae et al. | 473/345 |
| 8,235,844 | B2 * | 8/2012 | Albertsen et al. | 473/345 |
| 8,337,323 | B2 * | 12/2012 | Kuan et al. | 473/327 |
| 2003/0220154 | A1 * | 11/2003 | Anelli | 473/327 |
| 2012/0149494 | A1 * | 6/2012 | Takahashi et al. | 473/345 |

* cited by examiner

*Primary Examiner* — Sebastiano Passaniti
(74) *Attorney, Agent, or Firm* — Banner & Witcoff Ltd.

(57) ABSTRACT

A golf club includes a shaft and a club head. The club head includes a body member having a ball striking face, a heel, a toe, a rear and a crown. The crown may include a forward crown region, a rearward crown region, and a crown transition region therebetween. The rearward crown region may have a lower height than the forward crown region. The crown transition region may extend generally in a heel-to-toe direction. The vertical slope of the crown transition region may decrease as the crown transition region extends from the heel toward the toe. The crown transition region may lie at an angle from a front plane of the club head. Optionally, a club head may include a forward sole region, a rearward sole region, and a sole transition region therebetween.

18 Claims, 19 Drawing Sheets

GOLF CLUB HEAD AND GOLF CLUB WITH AERODYNAMIC FEATURES

FIELD

Aspects of this invention relate generally to golf clubs and golf club heads, and, in particular, to a golf club and golf club head with aerodynamic features.

BACKGROUND

The distance a golf ball travels when struck by a golf club is determined in large part by club head speed at the point of impact with the golf ball. Club head speed in turn can be affected by the wind resistance or drag associated with the club head, especially given the large club head sizes of typical modern drivers. The club head of a driver, fairway wood, or metal wood in particular experiences significant aerodynamic drag during its swing path. The drag experienced by the club head leads to reduced club head speed and, therefore, reduced distance of travel of the golf ball after it has been struck.

Air flows in a direction opposite to the golf club head's trajectory over those surfaces of the golf club head that are roughly parallel to the direction of airflow. An important factor affecting drag is the behavior of the air flow's boundary layer. The "boundary layer" is a thin layer of air that lies very close to the surface of the club head during its motion. As the airflow moves over the surfaces, it encounters an increasing pressure. This increase in pressure is called an "adverse pressure gradient" because it causes the airflow to slow down and lose momentum. As the pressure continues to increase, the airflow continues to slow down until it reaches a speed of zero, at which point it separates from the surface. The air stream will hug the club head's surfaces until the loss of momentum in the airflow's boundary layer causes it to separate from the surface. The separation of the air streams from the surfaces results in a low pressure separation region behind the club head (i.e., at the trailing edge as defined relative to the direction of air flowing over the club head). This low pressure separation region creates pressure drag. The larger the separation region, the greater the pressure drag.

One way to reduce or minimize the size of the low pressure separation region is by providing a streamlined form that allows laminar flow to be maintained for as long as possible, thereby delaying or eliminating the separation of the laminar air stream from the club surface.

Reducing the drag of the club head not only at the point of impact, but also during the course of the entire downswing prior to the point of impact, would result in improved club head speed and increased distance of travel of the golf ball. When analyzing the swing of golfers, it has been noted that the heel/hosel region of the club head leads the swing during a significant portion of the downswing and that the ball striking face only leads the swing at (or immediately before) the point of impact with the golf ball. The phrase "leading the swing" is meant to describe that portion of the club head that faces the direction of swing trajectory. For purposes of discussion, the golf club and golf club head are considered to be at 0° orientation when the ball striking face is leading the swing, i.e. at the point of impact. It has been noted that during a downswing, the golf club may be rotated by about 90° or more around the longitudinal axis of its shaft during the 90° of downswing prior to the point of impact with the golf ball.

During this final 90° portion of the downswing, the club head may be accelerated to approximately 65 miles per hour (mph) to over 100 mph, and in the case of some professional golfers, to as high as 140 mph. Further, as the speed of the club head increases, typically so does the drag acting on the club head. Thus, during this final 90° portion of the downswing, as the club head travels at speeds upwards of 100 mph, the drag force acting on the club head could significantly retard any further acceleration of the club head.

Club heads that have been designed to reduce the drag of the head at the point of impact, or from the point of view of the club face leading the swing, may not function well to reduce the drag during other phases of the swing cycle, such as when the heel region of the club head is leading the downswing.

It would be desirable to provide a golf club head that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

The principles of the invention may be used to provide a golf club head with improved aerodynamic performance. In accordance with certain aspects, a golf club head includes one or more drag reducing structures on the body member. The drag-reduction structures are expected to reduce drag for the body member during a golf swing from an end of a backswing through a downswing.

In accordance with certain aspects, a golf club includes a shaft and a club head secured to a distal end of the shaft. The club head includes a body member having a ball striking face, a heel, a toe, a rear and a crown. The crown includes a forward crown region, a rearward crown region, and a crown transition region. The forward crown region may extend rearwardly from the ball striking face. The rearward crown region may extend forwardly from the rear. The rearward crown region has a smaller height dimension than the forward crown region. The crown transition region may extend generally in a heel-to-toe direction between the forward crown region and the rearward crown region.

According to some aspects, the forward crown region may be substantially horizontally-oriented. The rearward crown region may also be substantially horizontally-oriented. The crown transition region may be substantially vertically-oriented crown.

According to other aspects, the slope of the crown transition region may decrease monotonically as the crown transition region extends from the heel toward the toe.

In accordance with other aspects, the crown transition region may lie at an angle that ranges from approximately 5 degrees to 40 degrees from a front plane of the club head.

The rearward crown region may have a substantially planar surface or a substantially convexly-curved surface, as viewed from a side perpendicular to a centerline of the club head. Further, the rearward crown region may have a substantially planar surface or a substantially convexly-curved surface, as viewed from the back of the club head along the centerline. Optionally, a majority of the surface of the rearward crown region may be either a substantially planar surface or a substantially convexly-curved surface.

The forward crown region may extend rearwardly from the ball striking face to a forward crown transition feature. The forward crown transition feature may be formed by the intersection of the forward crown region and the crown transition region. Further, the forward crown transition feature may be defined as having a tangent, drawn in a vertical plane that is parallel to the centerline of the club head when the club head is in the 60 degree lie angle position, at 45 degrees to the horizontal. A tangent to the forward crown transition region measured at a centerline of the club head may range from approximately 0 degrees to approximately 25 degrees from a front plane of the club head.

Similarly, the rearward crown region may extend forwardly from the rear to a rearward crown transition feature. The rearward crown transition feature may be formed by the intersection of the rearward crown region and the crown transition region. Further, the rearward crown transition feature may be defined as having a tangent, drawn in a vertical plane that is parallel to the centerline of the club head when the club head is in the 60 degree lie angle position, at 45 degrees to the horizontal. An angle of the rearward crown transition region measured at a centerline of the club head may range from approximately 10 degrees to approximately 35 degrees from a front plane of the club head.

Further, according to certain aspects, the height of the center of gravity of the club head may be less than or equal to 1.75 cm. The body member may have a volume of greater than equal to 420 cc. Alternatively, the body member may have a volume of greater than equal to 445 cc. The length and/or the breadth of the club head may be greater than 12.0 cm.

A channel may extend, at least partially, along and adjacent to the trailing edge of the aft body member. The channel, or portions thereof, may function as a Kammback structure over at least a portion of the downswing of the golf club.

In accordance with even further aspects, a club head includes a body member having a ball striking face, a heel, a toe, a rear and a sole. The sole includes a forward sole region, a rearward sole region, and a sole transition region. The forward sole region may extend rearwardly from the ball striking face. The rearward sole region may extend forwardly from the rear. The rearward sole region has a smaller height dimension than the forward sole region. The sole transition region may extend generally in a heel-to-toe direction between the forward sole region and the rearward sole region.

By providing a golf club head with one or more of the drag-reduction structures disclosed herein, it is expected that the total drag of the golf club head during a player's downswing can be reduced. This is highly advantageous since the reduced drag will lead to increased club head speed and, therefore, increased distance of travel of the golf ball after being struck by the club head.

These and additional features and advantages disclosed here will be further understood from the following detailed disclosure of certain embodiments.

Figure 1:
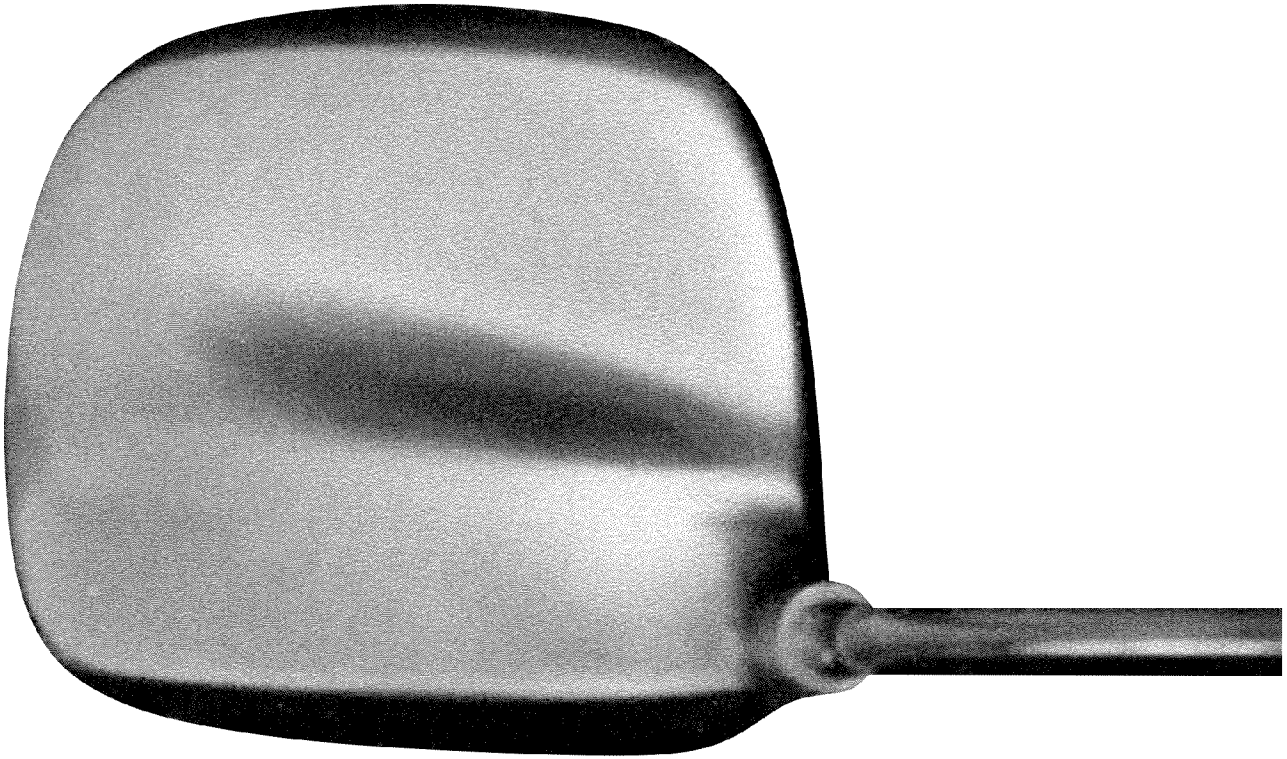
FIG. 1 is a top plan view of a golf club according to illustrative aspects.

The figures referred to above are not drawn necessarily to scale, should be understood to provide a representation of particular embodiments of the invention, and are merely conceptual in nature and illustrative of the principles involved. Some features of the golf club head depicted in the drawings may have been enlarged or distorted relative to others to facilitate explanation and understanding. The same reference numbers are used in the drawings for similar or identical components and features shown in various alternative embodiments. Golf club heads as disclosed herein would have configurations and components determined, in part, by the intended application and environment in which they are used.

DETAILED DESCRIPTION

Figure 2:
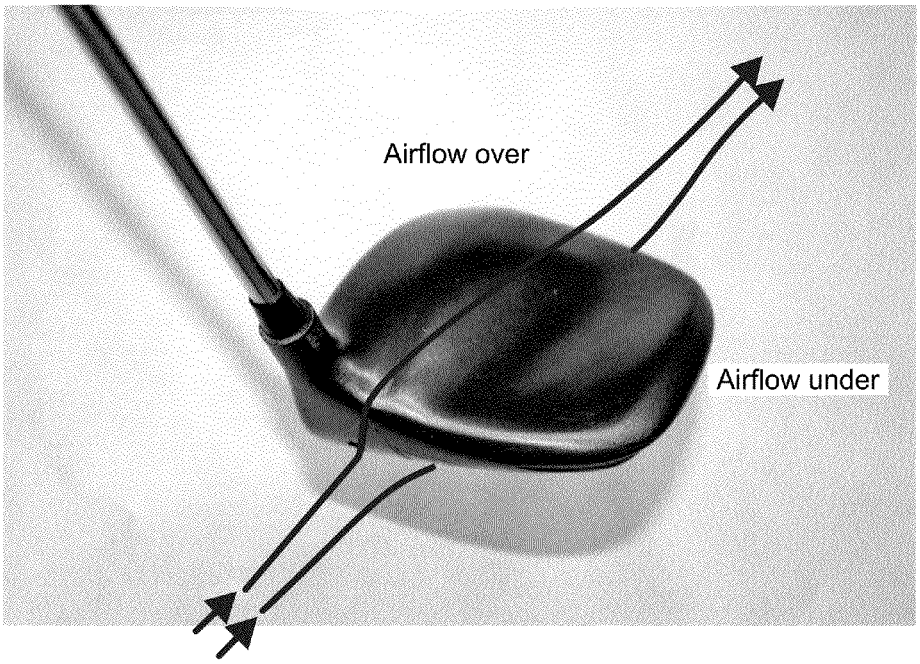
FIG. 2 is a perspective view of the golf club of FIG. 1, showing a schematic expected airflow over and under the club head when the heel leads the swing.

An illustrative embodiment of a golf club according to aspects of the invention is shown in FIGS. 1 and 2. As can generally be seen in FIG. 1, the top or crown of the club head may be provided with an elongated feature, generally extending from the heel toward the toe, which separates a front or forward crown region from a rear or rearward crown region. This elongated feature provides a transition region, wherein the height of the forward crown region is stepped down or transitioned to the height of the rearward crown region. By transitioning the height of the crown from the front or forward crown region to the rear or rearward crown region, it is expected that air flowing over and/or under the club head from the heel toward the toe (see FIG. 2) will encounter less resistance. Thus, it is expected that the transition region will result in reduced drag over the course of the golfer's downswing, higher club head speed at the moment of impact with the golf ball, and increased travel distance of the golf ball.

An embodiment of a golf club head 14 is shown schematically in FIGS. 3-8 in order to illustrate certain aspects of the invention. The golf club head 14 may be attached to a shaft 12

(see FIG. 5), to form a golf club 10. The golf club head 14 may be a driver, as shown. The shaft 12 of the golf club 10 may be made of various materials, such as steel, aluminum, titanium, graphite, or composite materials, as well as alloys and/or combinations thereof, including materials that are conventionally known and used in the art. Additionally, the shaft 12 may be attached to the club head 14 in any desired manner, including in conventional manners known and used in the art (e.g., via adhesives or cements at a hosel element, via fusing techniques (e.g., welding, brazing, soldering, etc.), via threads or other mechanical connectors (including releasable and adjustable mechanisms), via friction fits, via retaining element structures, etc.).

In the example structure of FIGS. 3-8, the club head 14 includes a body member 15 to which the shaft 12 is attached at a hosel or socket 16 configured for receiving the shaft 12 in known fashion. The body member 15 includes a plurality of portions, regions or surfaces. For example, the body member 15 includes a ball striking face 17, a crown 18, a toe 20, a rear 22, a heel 24, a hosel region 26 and a sole 28. For certain club heads, the body member 15 may be hollow.

Figure 4:
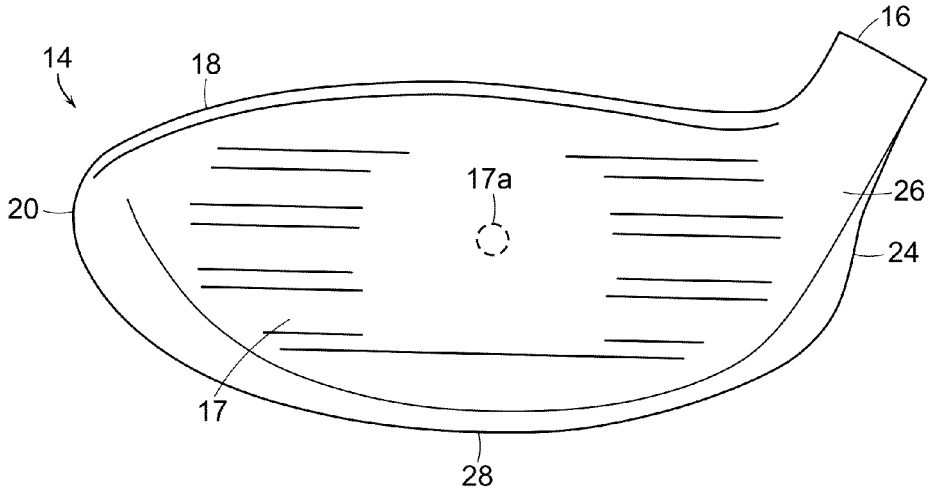
FIG. 4 is a schematic front view of the club head of FIG. 3, generally viewed from the toe side.
Figure 5:
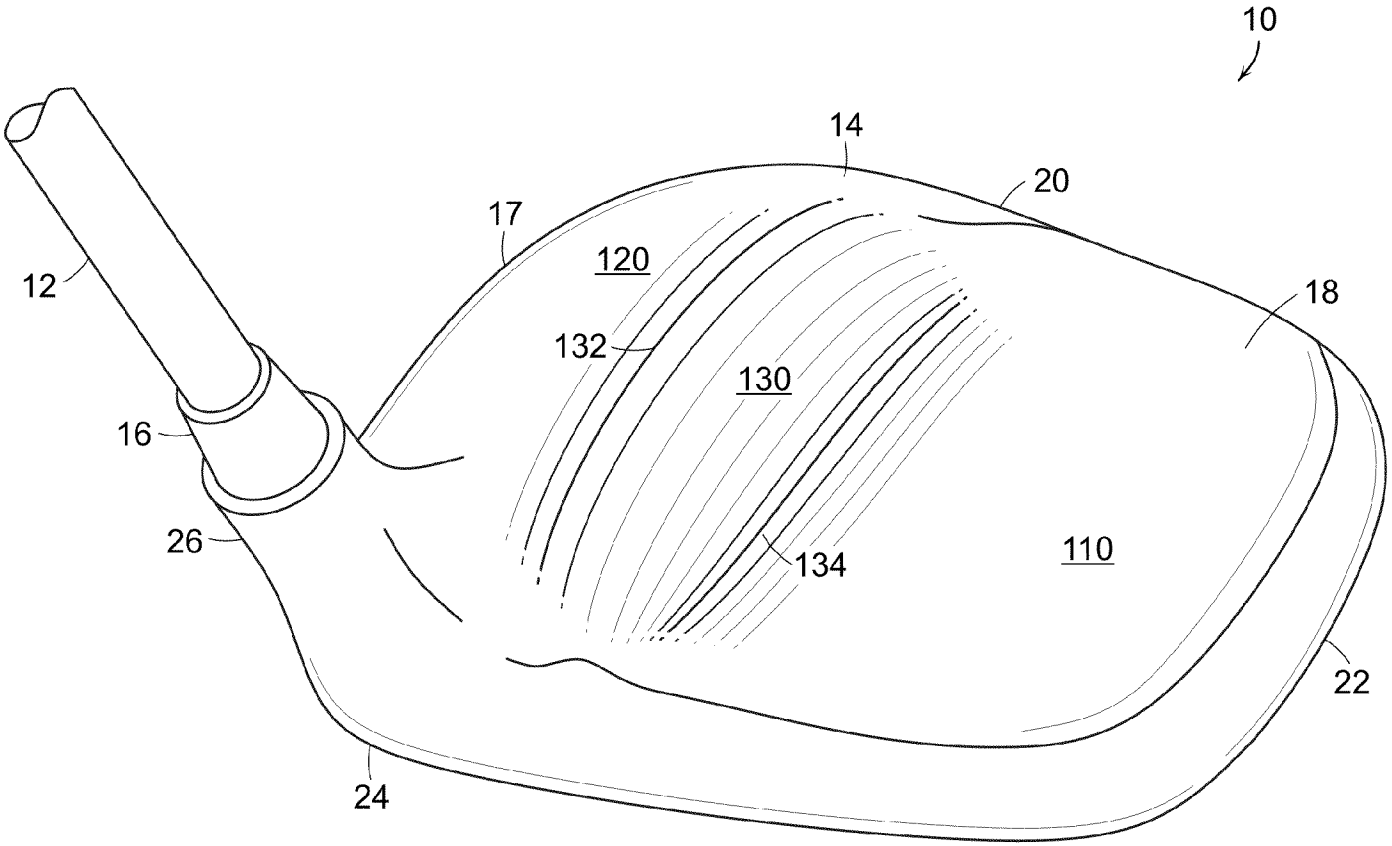
FIG. 5 is a schematic perspective view of the club head of FIG. 3, generally viewed from the top heel side.
Figure 6:
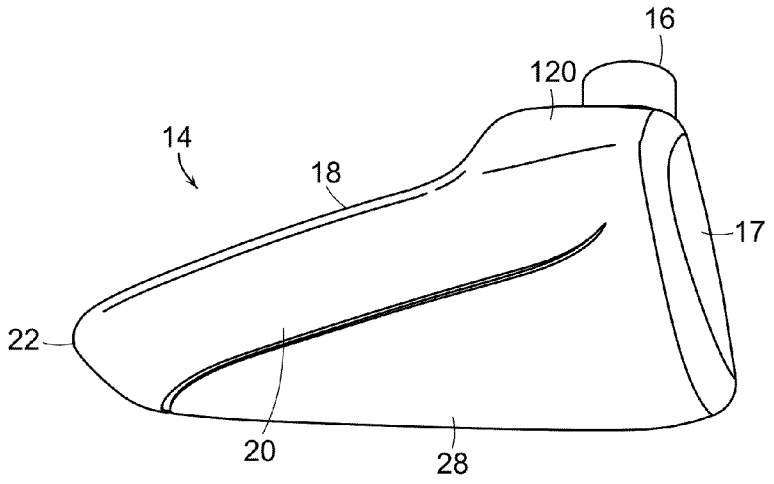
FIG. 6 is a schematic perspective view of the club head of FIG. 3, generally viewed from the toe side.
Figure 7:
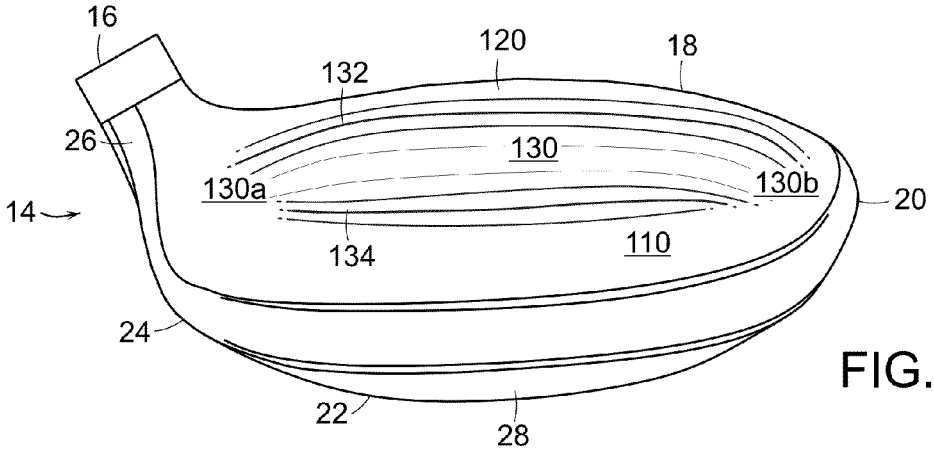
FIG. 7 is a schematic rear elevation view of the club head of FIG. 3.
Figure 8:
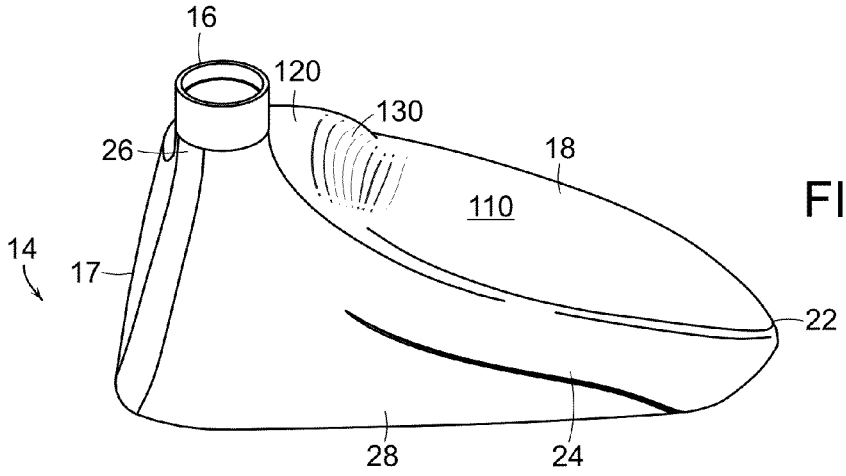
FIG. 8 is a schematic perspective view of the club head of FIG. 3, generally viewed from the heel side.

Referring to FIG. 4, the ball striking face 17 may be essentially flat or it may have a slight curvature or bow (for example, a "bulge" and/or a "roll"). Although the golf ball may contact the ball striking face 17 at any spot on the face, the desired-point-of-contact 17*a* of the ball striking face 17 with the golf ball is typically approximately centered within the ball striking face 17.

Still referring to FIGS. 3-8, the crown 18, which is located on the upper or top side of the club head 14, extends from the ball striking face 17 back toward the rear 22 of the golf club head 14. When the club head 14 is viewed from below, the crown 18 cannot be seen.

The sole 28, which is located on the lower or ground side of the club head 14 opposite to the crown 18, extends from the ball striking face 17 back toward the rear 22. As with the crown 18, the sole 28 extends across the width of the club head 14, from the heel 24 to the toe 20. When the club head 14 is viewed from above, the sole 28 cannot be seen.

The rear 22 is positioned opposite the ball striking face 17, is located between the crown 18 and the sole 28, and extends from the heel 24 to the toe 20. When the club head 14 is viewed from the front, the rear 22 cannot be seen.

The heel 24 extends from the ball striking face 17 to the rear 22. When the club head 14 is viewed from the toe-side, the heel 24 cannot be seen.

The toe 20 is shown as extending from the ball striking face 17 to the rear 22 on the side of the club head 14 opposite to the heel 24. When the club head 14 is viewed from the heel-side, the toe 20 cannot be seen.

The socket 16 for attaching the shaft 12 to the club head 14 is located within the hosel region 26. The hosel region 26 is shown as being located at the intersection of the ball striking face 17, the heel 24 and the crown 18 and may encompass those portions of the face 17, the heel 24 and the crown 18 that lie adjacent to the socket 16. Generally, the hosel region 26 includes surfaces that provide a transition from the socket 16 to the ball striking face 17, the heel 24, the crown 18 and/or the sole 28.

Figure 9:
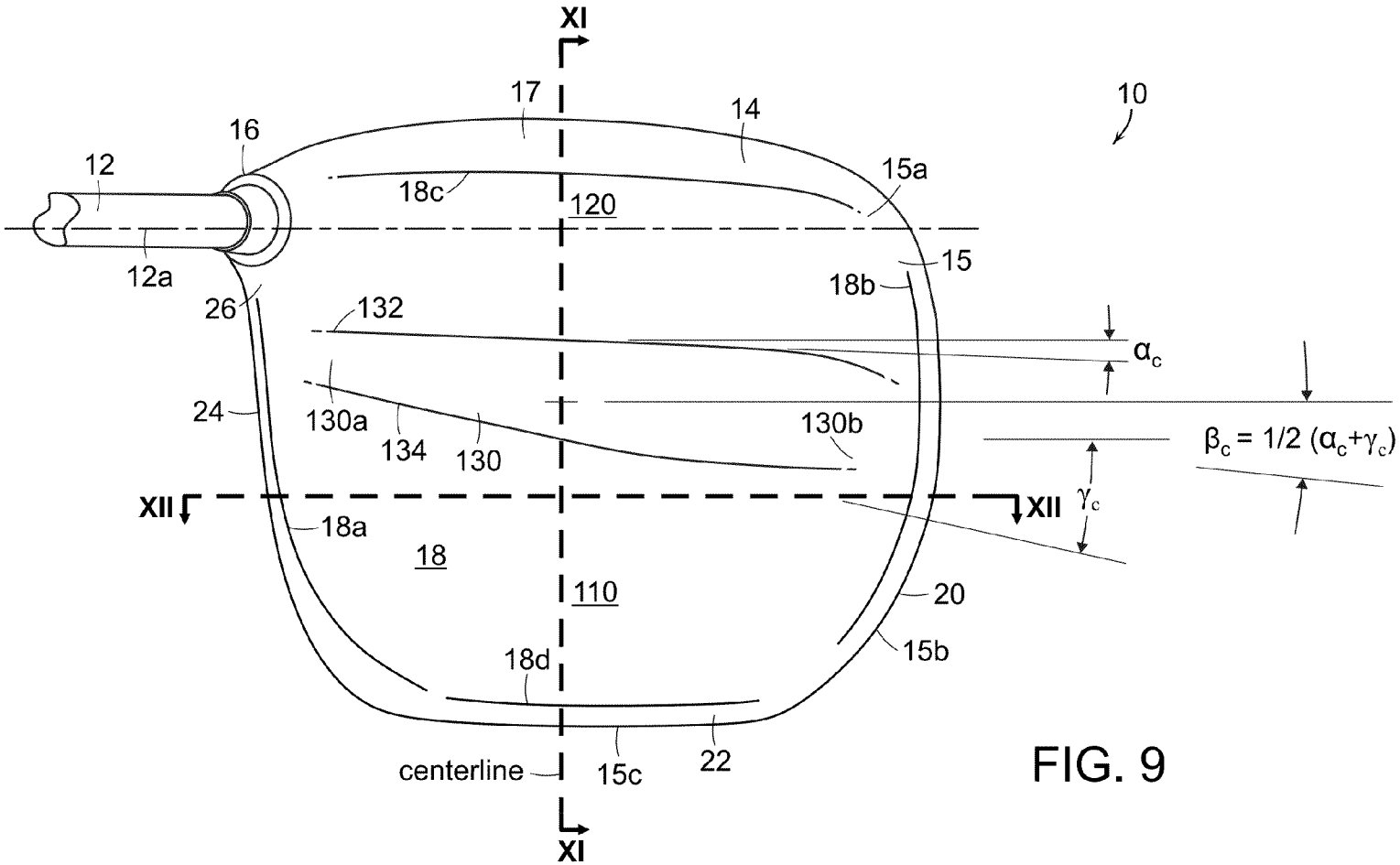
FIG. 9 is a schematic top view of a club head illustrating certain club head parameters in accordance with the disclosure.

FIG. 9 is a schematic top view of a club head illustrating certain club head parameters in accordance with the disclosure. For example, referring to FIG. 9, the body member 15 may be described as having a front body portion 15*a* and an aft body portion 15*b*. The front body portion 15*a* and the aft body portion 15*b* are not necessarily distinct components, but rather are general regions of the club head 14. Front body portion 15*a* may generally include the ball striking face 17 and those portions of the crown 18, toe 20, sole 28 and hosel region 26 that lie forward of the longitudinal axis 12*a* of the shaft 12 (when the club head is in the 60 degree lie angle position). The aft body portion 15*b* includes the remaining regions of the club head 14.

The body member 15 may be provided with an aft body member 15*b* having a generally or substantially squared profile of a trailing edge 15*c* when viewed from above and/or below. For purposes of this disclosure, the trailing edge 15*c* is defined as the perimeter edge of the aft body member 15*b* that would be contacted by a vertical when the club head is in the 60 degree lie angle position. Further, for purposes of this disclosure, the trailing edge is that portion of the vertically-contacted perimeter edge that extends around the back half of the club head. The club head 14 having such a generally squared profile could be described as a "square head." Although not a true square in geometric terms, the aft body member 15*b* would be considered substantially square as compared to a more traditional, rounded, club head. It is further to be appreciated by persons of ordinary skill in the art that the body member 15 may be provided with a more traditional round head shape. The phrase "round head" does not refer to a body member 15 having a back half that is completely round but, rather, to a body member 15 with an aft body member 15*b* having a generally or substantially rounded profile of a trailing edge 15*c* when viewed from above and/or below.

A longitudinal axis or shaft axis 12*a* extending longitudinally down the center of the shaft 12 is shown in FIG. 9. A grip or other handle element (not shown) may be positioned on the shaft 12 to provide a golfer with a slip resistant surface with which to grasp the golf club shaft 12.

Figure 10B:
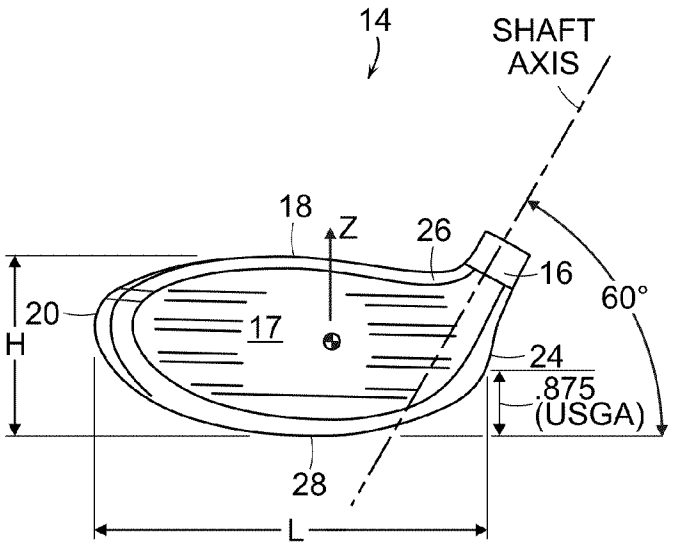
FIGS. 10A and 10B are a schematic top plan view and a schematic front elevation view, respectively, of the club head of FIG. 9 illustrating certain club head parameters.
Figure 10A:
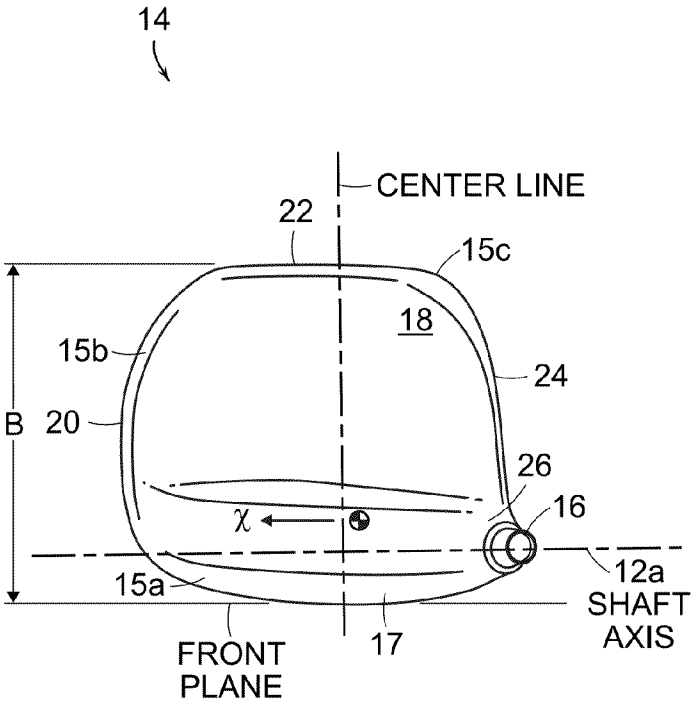

For purposes of this disclosure, and referring to FIGS. 10A and 10B, with a club head positioned at 60-degree lie angle as defined by the USGA (see USGA, "Procedure for Measuring the Club Head Size of Wood Clubs"), the "centerline" of the club head 14 may be considered to coincide with the indicator on the face squaring gauge when the face squaring gauge reads zero for clubs having a neutral face angle. The length (L) of the club head extends from the outermost point of the toe to the outermost point of the heel, as defined by the above-referenced USGA procedure. The breadth (B) of the club head extends from the outermost point of the face to the outermost point of the rear. Similar to the procedure for determining the outermost point of the toe (but now turned 90 degrees), the outermost points of the face and rear may be defined as the points of contact between the club head in the USGA 60-degree lie angle position with a vertical plate running parallel to the longitudinal axis 12*a* of the shaft 12. The vertical plane associated with this measurement of the outermost point of the face may be referred to as the "front plane" of the club head. The height (H) of the club head extends from the uppermost point of the crown to the lowermost point of the sole, as defined by the above-referenced USGA procedure. The terms "above," "upper," "top," "below," "lower," "bottom," "front," "back," "heel-side," "toe-side," etc. all may refer to views associated with the club head 14 when it is positioned at this USGA 60-degree lie angle.

Figure 11A:
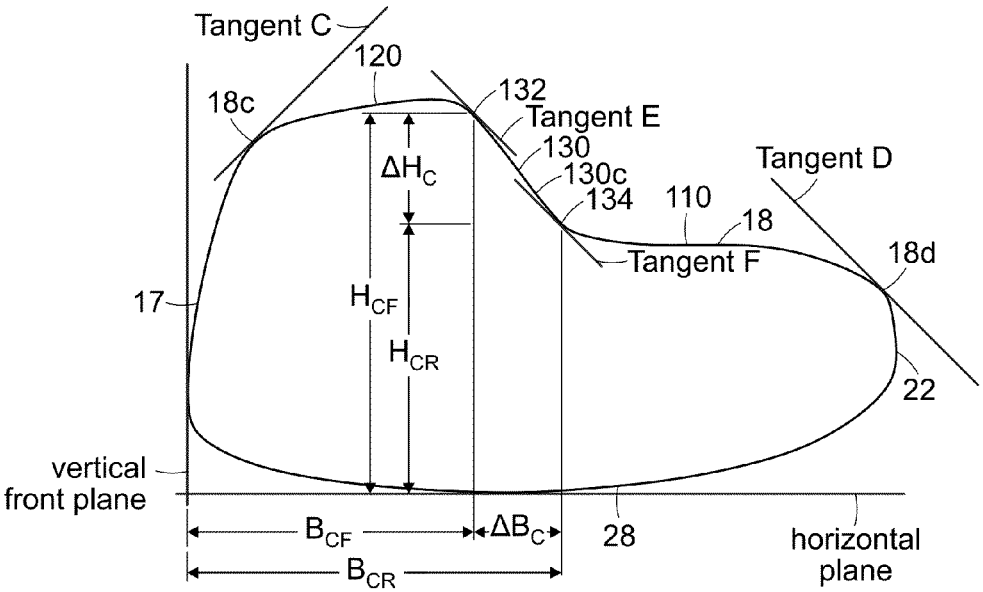
FIG. 11A is a schematic of a surface profile taken along section XI-XI of the club head of FIG. 9 illustrating certain club head parameters. Section XI-XI of FIG. 9 is coincident with the centerline of the club head.
Figure 11B:
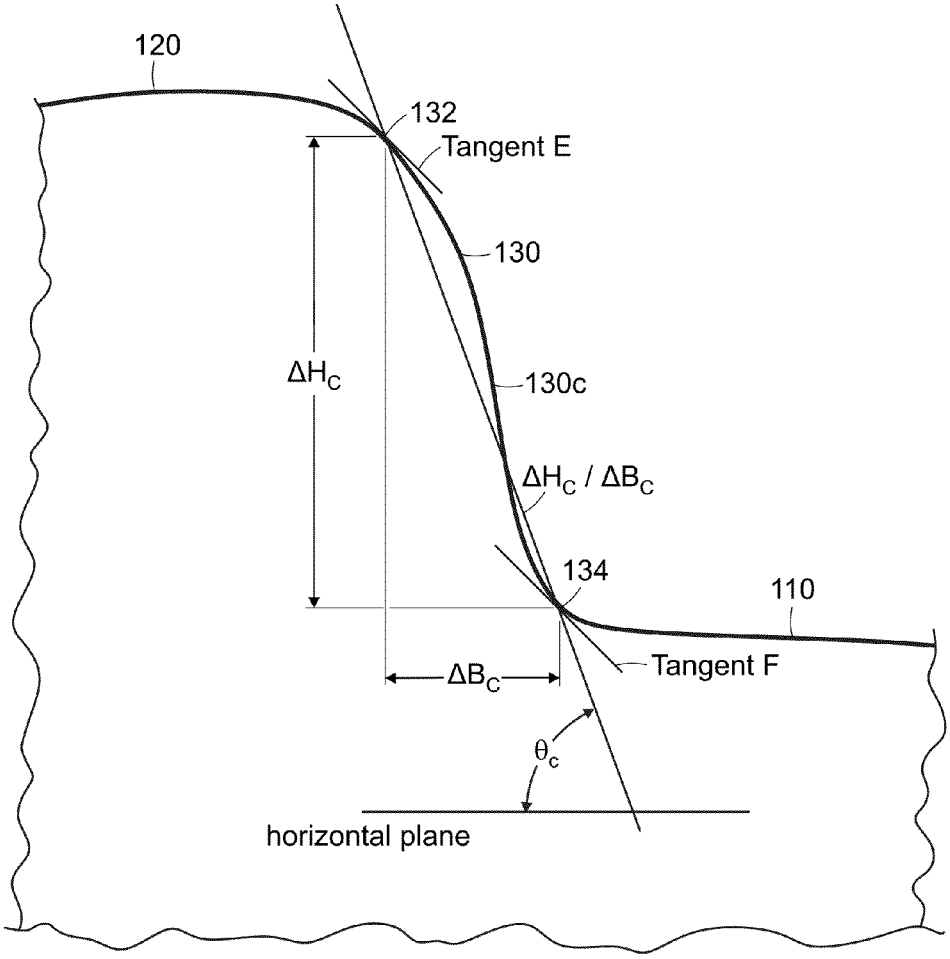
FIG. 11B is a schematic of an enlarged portion of the surface profile of FIG. 11A, particularly showing details of the crown transition region.

FIG. 11A is a schematic of a surface profile taken along section XI-XI, i.e., along the centerline, of the club head of FIG. 9 for the purpose of illustrating certain club head parameters. FIG. 11B is a schematic of an enlarged portion of the surface profile of the crown transition region of FIG. 11A. For purposes of this disclosure, "breadth" (B) measurements or dimensions are taken parallel to the centerline of the club head and parallel to the ground. A "centerline breadth" ($B_C$) measurement or dimension refers to the breadth as measured along the centerline of the club head. Generally, a breadth (B) measurement is measured from the front plane; a breadth dimension may be the difference (ΔB) between two breadth (B) measurements. "Height" (H) measurements or dimensions are taken parallel to a vertical plane when the club head is in its 60-degree lie angle position. A "centerline height" ($H_C$) measurement or dimension refers to a vertical measurement taken at the centerline of the club head. Generally, a height (H) measurement is measured from the lowermost horizontal plane; a height dimension may be the difference (ΔH) between two height (H) measurements.

According to certain aspects, the various embodiments of various club heads 14 may include one or more drag-reducing structures in order to reduce the overall drag on the club head 14 during a user's golf swing from the end of a user's backswing through the downswing. The drag-reducing structures may be configured to provide reduced drag during the entire downswing of a user's golf swing or during a significant portion of the user's downswing, not just at the point of impact.

As described in detail in co-pending U.S. patent application Ser. No. 12/779,669, filed May 13, 2010, entitled "Golf Club Assembly and Golf Club With Aerodynamic Features," and naming Gary Tavares, et al. as inventors, which is incorporated herein in its entirety, it is noted that the ball striking face 17 does not lead the swing over the entire course of a player's downswing. Only at the point of impact with a golf ball is the ball striking face 17 ideally leading the swing, i.e., the ball striking face 17 is ideally substantially perpendicular to the direction of travel of club head 14 (and the flight of the golf ball) at the point of impact. However, it is known that during the player's backswing and during the player's downswing, the player's hands, wrists, arms, shoulders, torso, and/or hips twist the golf club 10 such that yaw is introduced, thereby pivoting the ball striking face 17 away from its position at impact. With the orientation of the ball striking face 17 at the point of impact considered to be 0°, during the backswing the ball striking face twists away from the user toward the toe 20 and the rear 22 to a maximum of 90° (or more) of yaw, at which point the heel 24 is the leading edge of the club head 14.

Second it may be noted, that aerodynamic boundary layer phenomena acting over the course of the player's downswing may cause a reduction in club speed due to drag. During a player's downswing, the air pressure and the energy in the boundary layer flowing over the surface of the club head tend to increase as the air travels over the length of the club head. The greater the air pressure and energy in the boundary layer, the more likely the boundary layer will separate from the club head 14, thereby creating a low pressure separation zone behind the club head. The larger the separation zone, the greater the drag. Thus, according to certain aspects, drag-reducing structures may be designed to reduce the air pressure and the energy in the boundary layer, thereby allowing the boundary layer to maintain contact with the surface of the club head over a longer distance and thereby reducing the size of the separation zone. Further, according to certain aspects, the drag-reducing structures may be designed to maintain laminar flow over the surface of the club head over the greatest distance possible. A laminar flow results in less drag due to friction over the surface of the club head, and thus, maintaining a laminar air flow over the entire surface of the club head may be the most desirable. Further, by delaying the separation of the boundary layer flow, from the surface of the club head, the size of the separation zone in the trailing region is reduce and correspondingly drag due to the low-pressure separation zone is reduced.

In general, it is expected that minimizing the size of the separation zone behind the club head 14, i.e., maintaining a boundary layer airflow for as long as possible, should result in the least drag. Further, it is expected that maintaining a boundary layer over the club head 14 as the club head changes orientation during the player's downswing should also result in increase club head speed. Thus, some of the example drag-reducing structures described in more detail below may be provided to maintain a boundary layer airflow over one or more of the surfaces of the club head 14 when the ball striking face 17 is generally leading the swing, i.e., when air flows over the club head 14 from the ball striking face 17 toward the rear 22. Additionally, it is expected that some of the example drag-reducing structures described in more detail below may provide various means to maintain a boundary layer airflow over one or more surfaces of the club head 14 when the heel 24 is generally leading the swing, i.e., when air flows over the club head 14 from the heel 24 toward the toe 20. Moreover, it is expected that some of the example drag-reducing structures described in more detail below may provide various means to maintain a boundary layer airflow over one or more surfaces of the club head 14 when the hosel region 26 is generally leading the swing, i.e., when air flows over the club head 14 from the hosel region 26 toward the toe 20 and/or the rear 22. The example drag-reducing structures disclosed herein may be incorporated singly or in combination in club head 14 and are applicable to any and all embodiments of the club head 14.

Referring then to FIGS. 3-8, the crown 18 extends from the ball striking face 17 to the rear 22 and from the heel 24 to the toe 20. According to certain aspects, a drag-reducing structure may be provided as a stepped-down or rearward crown region 110 formed in the crown 18. The crown 18 includes a forward crown region 120 that is located adjacent the ball striking face 17. The rearward crown region 110 is located adjacent the rear 22. The rearward crown region 110 is stepped down or has a reduced height relative to the forward crown region 120. By way of non-limiting example, the maximum height of the rearward crown region may be less than the minimum height of the forward crown region. Thus, referring to FIG. 2, which schematically illustrates air flowing from the heel 24 toward the toe 20 over and under the club head, it is expected that the club head 14 with the rearward crown region 110 will more readily maintain a laminar boundary layer airflow for a longer distance over the surface of the crown 18 (relative to club heads without the stepped down crown region) when the heel 24 is generally leading the swing.

As shown in FIGS. 3-8 and also in FIG. 11A, the forward crown region 120 extends rearwardly from the ball striking face 17. Further, the forward crown region 120 extends from the hosel region 26 to the toe 20. Generally, the forward crown region 120 has a relatively horizontally-oriented surface. The surface may have a shallow or gentle convex curvature. The transition from the forward crown region 120 to the ball striking face 17 may be provided as a generally convex, smooth merging of the surface of the forward crown region 120 to the surface of the ball striking face 17. Similarly, the transition from the forward crown region 120 to the toe 20 may be a generally convex, smooth merging of the surface of the forward crown region 120 to the surface of the toe 20. Additionally, the transition of the forward crown region 120 to the hosel region 26 is also a smooth merging of the surface of the hosel region 26 to the surface of the forward crown region 120, but this transition generally includes a concavely curved surface.

The rearward crown region 110 extends forward from the rear 22. Further, the rearward crown region 110 extends from the heel 24 to the toe 20. According to some aspects, and referring for example to FIG. 8, this rearward crown region 110 provides a reduced club head profile when viewed from the heel-side of the club head 14, i.e., the height of the rearward crown region 110 is less than the height of the forward crown region 120. Generally, referring for example to FIG. 11A, the rearward crown region 110 may have a relatively horizontally-oriented surface with a relatively planar or a slightly convex curvature. At the transition from the rearward crown region 110 to the heel 24, a generally convex, smooth merging of the surface of the rearward crown region 110 to the surface of the heel 24 may be provided. Similarly, the transition from the rearward crown region 110 to the toe 20 involves a generally convex, smooth merging of the surface of the rearward crown region 110 to the surface of the toe 20. Even further, the transition from the rearward crown region 110 to the rear 22 may include a generally convex, smooth merging of the surface of the rearward crown region 110 to the surface of the rear 22.

According to certain aspects, and as best shown in FIGS. 1, 2, 3, 5 and 7, another drag-reducing structure may be provided as a generally elongated crown transition region 130 located between the forward crown region 120 and the rearward crown region 110. The crown transition region 130 may be formed as an aerodynamically smooth, continuous surface, particularly as the crown transition region 130 extends in the heel-to-toe direction. The relatively smooth extent of the crown transition region 130 in the heel-to-toe direction is expected to assist in the maintenance of a laminar boundary layer over the crown 18 (particularly when the heel 24 leads the swing). In combination with the reduced profile presented by the club head 14 due to the lowered crown region 110, the aerodynamically-shaped crown transition region 130 is expected to provide a more aerodynamically efficient club head 14.

The crown transition region 130 generally extends from the heel 24 toward the toe 20. In other words, the crown transition region 130 may be generally oriented in a heel-to-toe direction. Further, the crown transition region 130 extends across the centerline of the club head 14. By way of non-limiting examples, the crown transition region 130 may extend from the heel 24 to the toe 20, from the heel-to-crown transition feature 18*a* toward the toe 20, or even from the heel-to-crown transition feature 18*a* to the toe-to-crown transition feature 18*b*.

Thus, as shown in FIGS. 1, 2, 3, 5 and 7 and also in FIGS. 13A-13E, the crown transition region 130 may be a generally elongated feature that extends from a heel-side end 130*a* to a toe-side end 130*b*. The crown transition region 130 is bounded along its forward crown edge by a forward crown transition feature 132 and along its rearward crown edge by a rearward crown transition feature 134. Thus, the heel-side end 130*a* and the toe-side end 130*b* of the crown transition region 130 are also bounded by the forward and rearward crown transition features 132, 134.

As shown in FIGS. 1 and 2 and also in profile in FIGS. 11A, 11B and 14A-14D, the crown transition region 130 may provide a relatively vertically-oriented crown surface extending between the relatively horizontally-oriented surface of the forward crown region 120 and the relatively horizontally-oriented surface of the rearward crown region 110. When viewed from a perpendicular to the centerline, as in FIGS. 11A, 11B and 14A, the transition from the forward crown region 120 to the rearward crown region 110 may be provided as a gradual transition between the forward crown transition feature 132 and the rearward crown transition feature 134. Alternatively, the transition region 130 may provide a more abrupt transition from the forward crown region 120 to the rearward crown region 110, as for example shown in FIGS. 14C and 14D. The abruptness of the transition may be represented by the slope of the crown transition region 130, i.e., the ratio ($\Delta H_C/\Delta B_C$) of the change in height ($\Delta H_C$) of the crown transition region 130 to the change in breadth ($\Delta B_C$) of the crown transition region 130. Another way of representing the abruptness of the crown transition region 130 is with the angle ($\theta_C$) of the slope, i.e., the tangent of the angle ($\theta_C$) is the slope. Generally, the crown transition region 130 would be provided as a smooth transition, i.e., the transition surface would not include sharp corners or jagged features, although ripples or undulations are considered within the scope of the invention.

The height dimension ($\Delta H_C$) of the crown transition region 130 is measured as the difference between the height of the forward crown transition feature 132 ($H_{CF}$) and the height of the rearward crown transition feature 134 ($H_{CR}$). Referring to FIGS. 11A and 11B, the change in height $\Delta H_C$ is $H_{CF}$ minus $H_{CR}$. The breadth dimension ($\Delta B_C$) of the crown transition region 130 is measured as the difference between the breadth of the rearward crown transition feature 134 ($B_{CR}$) and the breadth of the forward crown transition feature 132 ($B_{CF}$). Thus, still referring to FIGS. 11A and 11B, the breadth dimension $\Delta B_C$ of the crown transition region 130 is $B_{CR}$ minus $B_{CF}$. This breadth dimension $\Delta B_C$ may vary, i.e., increasing and/or decreasing, as the crown transition region 130 extends from the heel 24 towards the toe 20. A centerline slope ($\Delta H_C/\Delta B_C$) of the crown transition region 130 is defined as the slope of the crown transition region 130 measured along the centerline of the club head 14.

The slope ($\Delta H_C/\Delta B_C$) of the crown transition region 130 may vary as the transition region extends from the heel towards the toe. By way of non-limiting example, the crown transition region 130 may be steepest at its heel-side end 130*a*, i.e., closest to the heel-to-crown transition feature 18*a*, and progressively less steep as it extends toward the toe 20. Thus, the crown transition region 130 may have a slope ($\Delta H_C/\Delta B_C$) that decreases monotonically as it extends from the heel 24 toward the toe 20. As another non-limiting example, the crown transition region 130 may be steepest in its central region and progressively less steep as it extends toward the heel 24 and towards the toe 20. By way of a non-limiting example, the slope ($\Delta H_C/\Delta B_C$) of the crown transition region 130 at the centerline may be less than or equal to approximately 80% of the slope ($\Delta H_C/\Delta B_C$) of the crown transition region 130 at the heel-side end 130*a*. Alternatively, the slope ($\Delta H_C/\Delta B_C$) of the crown transition region 130 at the centerline may be less than or equal to approximately 70%, less than or equal to approximately 60%, less than or equal to approximately 50%, or even less than or equal to approximately 40% of the slope ($\Delta H_C/\Delta B_C$) of the crown transition region 130 at the heel-side end 130*a*.

Alternatively, the maximum slope of the crown transition region 130 need not be at the heel-side end 130*a*. Thus, by way of even other non-limiting examples, the slope ($\Delta H_C/\Delta B_C$) of the crown transition region 130 at the centerline may be less than or equal to approximately 80%, less than or equal to approximately 70%, less than or equal to approximately 60%, less than or equal to approximately 50%, or even less than or equal to approximately 40% of the maximum slope of the crown transition region 130. Further, the slope ($\Delta H_C/\Delta B_C$) of the crown transition region 130 at the centerline may range from approximately 30% to approximately 80%, from approximately 30% to approximately 70%, from approximately 30% to approximately 60%, or even from approximately 50% to approximately 80% of the maximum slope of the crown transition region 130.

According to some aspects, the slope ($\Delta H_C/\Delta B_C$) of the crown transition region 130 may be equal to approximately 1.0. This corresponds to an angle ($\theta_C$) of the slope ($\Delta H_C/\Delta B_C$) of approximately 45 degrees. According to other aspects, the angle ($\theta_C$) of the slope ($\Delta H_C/\Delta B_C$) may be approximately 45 degrees, approximately 50 degrees, or even approximately 55 degrees. These slopes ($\Delta H_C/\Delta B_C$) would generally be considered to be relatively gradual transitions. According to even other aspects, the angle ($\theta_C$) of the slope ($\Delta H_C/\Delta B_C$) may be approximately 60 degrees, approximately 65 degrees, approximately 70 degrees or even approximately 75 degrees. These slopes ($\Delta H_C/\Delta B_C$) would generally be considered to be moderate transitions. According to even other aspects, the angle ($\theta_C$) of the slope ($\Delta H_C/\Delta B_C$) may be approximately 80 degrees, approximately 85 degrees, approximately 90 degrees, or even greater than approximately 90 degrees (i.e., when the crown transition region 130 folds back under the forward crown region 120). These slopes ($\Delta H_C/\Delta B_C$) would generally be considered to be abrupt transitions.

Figure 14B:
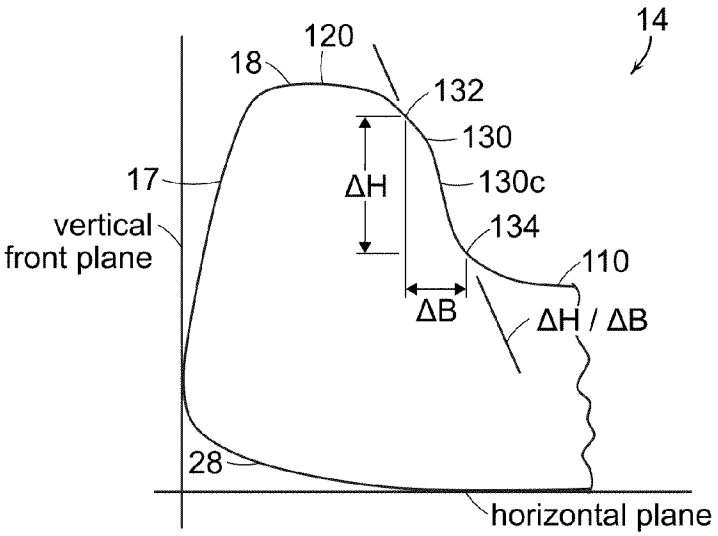
FIGS. 14A through 14D are schematics of various surface profiles of the crown transition feature taken along the centerlines of club heads according to certain aspects.
Figure 14A:
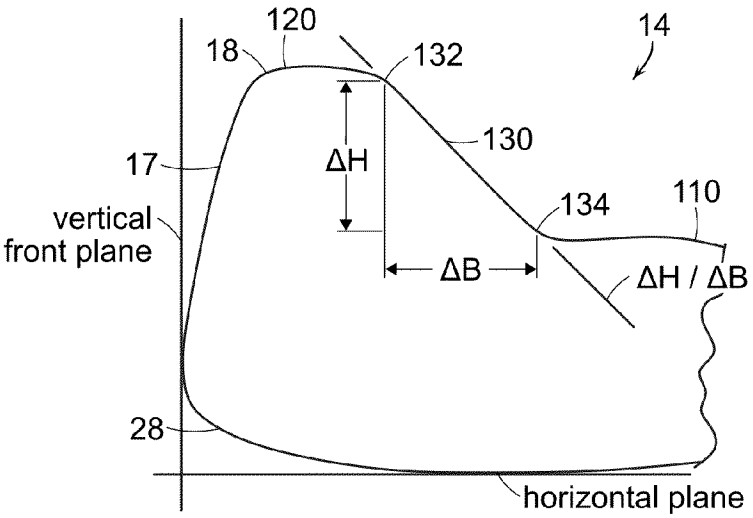
Figure 14D:
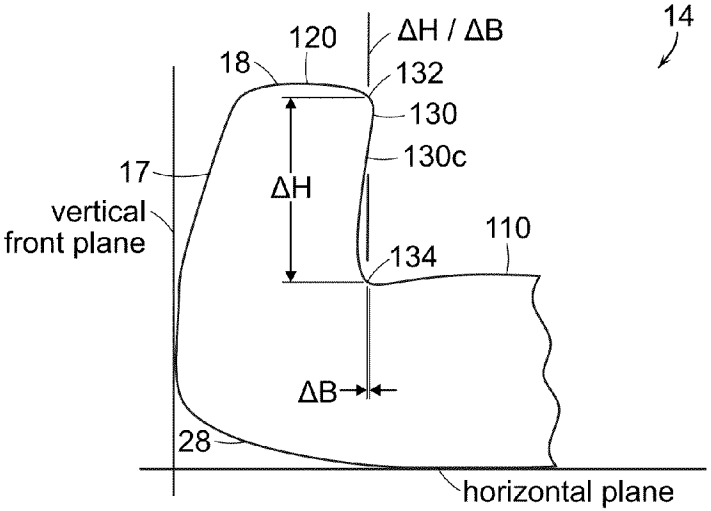
Figure 14C:
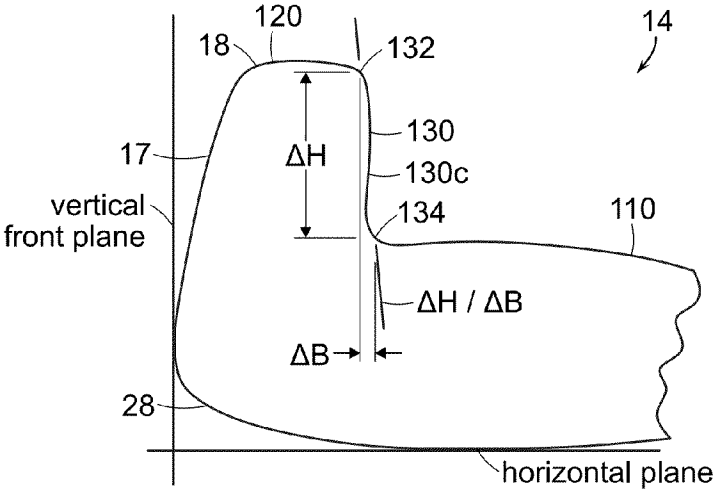

FIGS. 14A-14D schematically illustrate various surface profiles of exemplary crown transition regions 130, as viewed from a perpendicular to the centerline. FIG. 14A illustrates a crown transition region having an angle $\theta_C$ of the slope $\Delta H_C/\Delta B_C$ of between approximately 40 to approximately 50 degrees. FIG. 14B illustrates a crown transition region having an angle $\theta_C$ of the slope $\Delta H_C/\Delta B_C$ of between approximately 60 to approximately 70 degrees. FIG. 14C illustrates a crown transition region having an almost vertical slope, i.e., the angle $\theta_C$ of the slope $\Delta H_C/\Delta B_C$ lies between approximately 80 to approximately 90 degrees. Finally, FIG. 14D illustrates a crown transition region having an angle $\theta_C$ of the slope $\Delta H_C/\Delta B_C$ of between approximately 90 to approximately 100 degrees.

At the centerline of the club head 14 and referring to FIGS. 11A and 11B and also to the schematic illustrations of FIGS. 14A-14D, the height dimension of the crown transition region 130 (i.e., the difference in height ($\Delta H_C = H_{CF} - H_{CR}$) from the forward crown transition feature 132 to the rearward crown transition feature 134 at the centerline) may range from approximately 5 mm to approximately 30 mm. More preferably, the centerline height dimension $\Delta H$ of the crown transition region 130 may range from approximately 5 mm to approximately 25, from approximately 5 mm to approximately 20, or even from approximately 5 mm to approximately 15. For relatively shallow crown transition regions 130 the centerline height dimension $\Delta H_C$ may be less than or equal to 10 mm; for relatively deep crown transition regions 130 the centerline height dimension $\Delta H_C$ may be greater than or equal to 15 mm.

Further, at the centerline of the club head 14, the breadth dimension (i.e., $\Delta B_C = B_{CR} - B_{CF}$) of the crown transition region 130 may range from approximately 5 mm to approximately 30 mm. More preferably, the breadth dimension $\Delta B_C$ of the crown transition region 130 at the centerline may range from approximately 5 mm to approximately 25, from approximately 5 mm to approximately 20, or even from approximately 5 mm to approximately 15. For relatively narrow crown transition regions 130 the breadth dimension $\Delta B_C$ at the centerline may be less than or equal to 10 mm; for relatively broad crown transition regions 130 the breadth dimension $\Delta B_C$ at the centerline may be greater than or equal to 15 mm. According to other aspects, the breadth dimension $\Delta B_C$ of the crown transition region 130 at the centerline ($\Delta B_C = B_{CR} - B_{CF}$) may be less than or equal to approximately 25%, approximately 20%, approximately 15%, approximately 10%, or even approximately 5% of the maximum breath B of the club head 14.

According to even other aspects, the crown transition region 130 may be limited to the middle 50% of the total breadth (B) of the club head 14. In other words, according to this aspect, if the breadth (B) of the club head 14 is divided into four quadrants, the crown transition region 130 does not lie in the quadrant closest to the ball striking face 17 nor does the crown transition region 130 lie in the quadrant closest to the rear 22.

Further, the height of the crown transition region 130 may vary as the crown transition region 130 extends away from the heel 24. The height dimension ($\Delta H_C$) of the crown transition region 130, i.e., the difference in height from the forward crown transition feature 132 ($H_{CF}$) to the rearward crown transition feature 134 ($H_{CR}$), may be measured in any vertical plane that is parallel to the centerline of the club head 14. In the illustrative embodiment shown best in FIG. 7, the height of the crown transition region 130 initially increases as the region 130 extends away from the heel-side end 130*a*, then stays relatively constant until it crosses the centerline of the club head 14, and finally decreases as the region approaches the toe-side end 130*b*. Thus, by way of non-limiting example, the height dimension ($\Delta H_C$) of the crown transition region 130 at the heel-side end 130*a* may be less than the height dimension ($\Delta H_C$) of the crown transition region at the centerline. This increase in the height dimension of the crown transition region 130 may arise because the height ($H_{CF}$) of the forward crown transition feature 132 may be greater at the centerline than at the heel 24, while the height ($H_{CR}$) of the rearward crown transition feature 134 may remain relatively constant across the length of the club head 14. Further, the height dimension ($\Delta H_C$) of the crown transition region 130 at the centerline may be greater than the height dimension ($\Delta H_C$) of the crown transition region at the toe-side end 130*b*. By way of non-limiting example, the maximum height dimension of the crown transition region 130 may range from approximately 5 to approximately 30 mm. Alternatively, the maximum height dimension of the crown transition region 130 may be less than or equal to 15 mm.

Further, according to another aspect, the crown transition region 130 may be provided with a fairly constant height dimension ($\Delta H_C$). Thus, by way of non-limiting examples, the difference between the maximum height dimension ($\Delta H_{CMAX}$) and the minimum height dimension ($\Delta H_{CMIN}$) of the crown transition region 130, i.e., between the heel-side end 130*a* and the toe-side end 130*b*, may be less than or equal to approximately 10 mm, less than or equal to approximately 8 mm, less than or equal to 6 mm, less than or equal to 4 mm, or even less than or equal to less than 2 mm.

Similarly, the crown transition region 130 may change in breadth as the crown transition region 130 extends away from the heel 24. FIG. 3 and FIGS. 13A-13E schematically illustrate various shapes for exemplary crown transition regions 130, as viewed from above. Referring to FIGS. 11A and 11B, the breadth dimension ($\Delta B_C$) of the crown transition region 130, i.e., the difference in breadth from the rearward crown transition feature 134 ($B_{CR}$) to the forward crown transition feature 132 ($B_{CF}$), may be measured in any vertical plane that is parallel to the centerline of the club head 14. In the embodiment shown in FIG. 3, the breadth dimension ($\Delta B_C$) of the crown transition region 130 initially increases as the region 130 extends away from the heel-side end 130*a* until it crosses the centerline of the club head 14 and then decreases as the transition region 130 approaches the toe-side end 130*b*. Thus, by way of non-limiting example, the breadth dimension ($\Delta B_C$) of the crown transition region 130 at the heel-side end 130*a* may be less than the breadth dimension ($\Delta B$) of the crown transition region 130 at the centerline. Even further, the breadth dimension ($\Delta B_C$) of the crown transition region 130 at the heel-side end 130*a* may be less than at the centerline and the breadth dimension ($\Delta B_C$) at the centerline may be less than the breadth dimension ($\Delta B_C$) of the crown transition region at the toe-side end 130*b* (see also FIGS. 13A and 13B). In other words, according to some embodiments, the breadth dimension ($\Delta B_C$) of the crown transition region 130 may increase along its length from the heel-side end 130*a* to the toe-side end 130*b*. According to some aspects, the breadth dimension ($\Delta B_C$) of the crown transition region 130 at the heel-side end 130*a* may be less than or equal to approximately 50%, approximately 30% or even approximately 20% of the maximum breadth (B) of the club head 14.

Figure 13A:
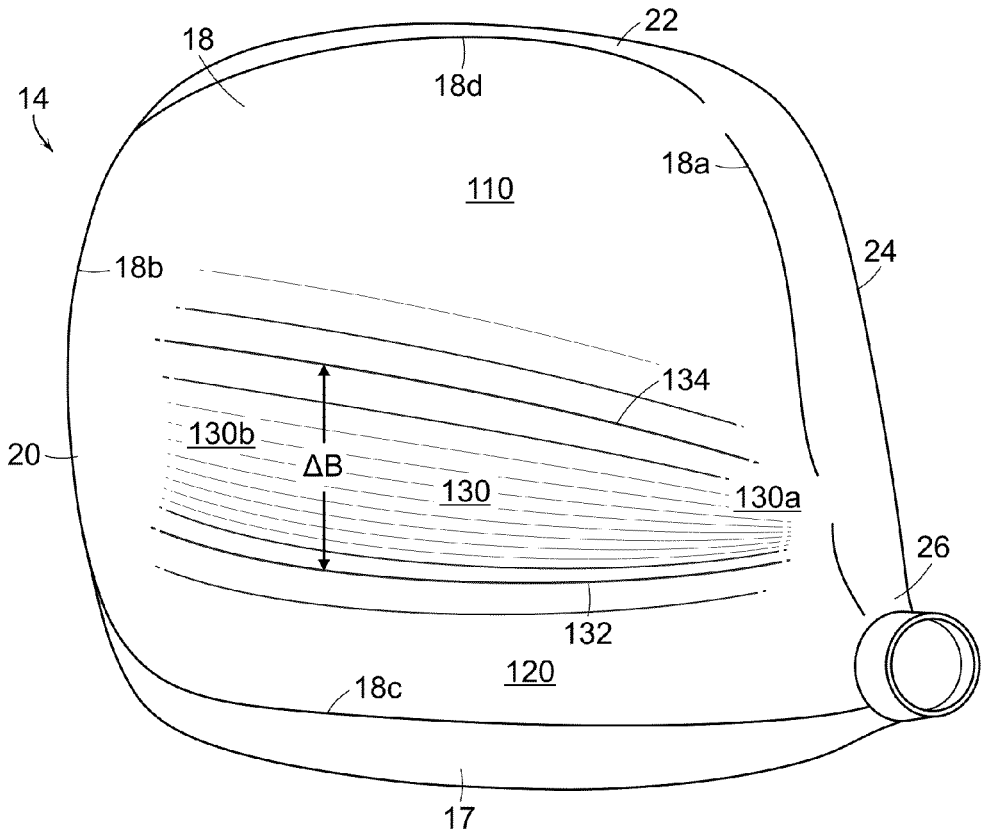
FIGS. 13A through 13E are schematic top plan views of club heads according to other example aspects.
Figure 13B:
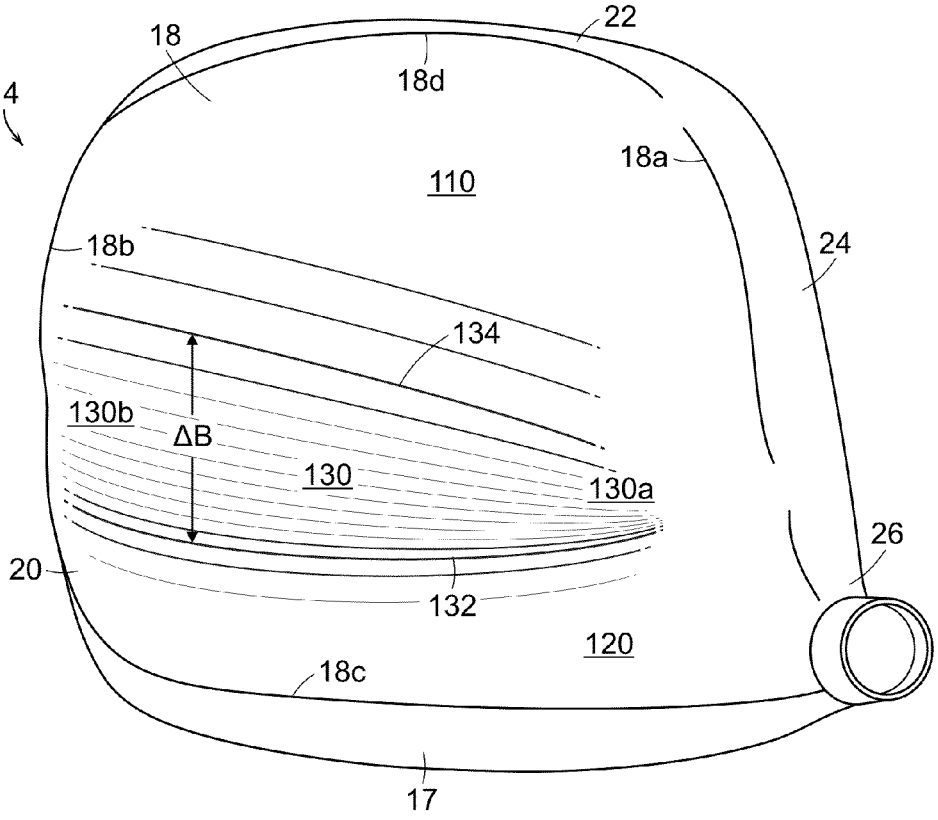
Figure 13C:
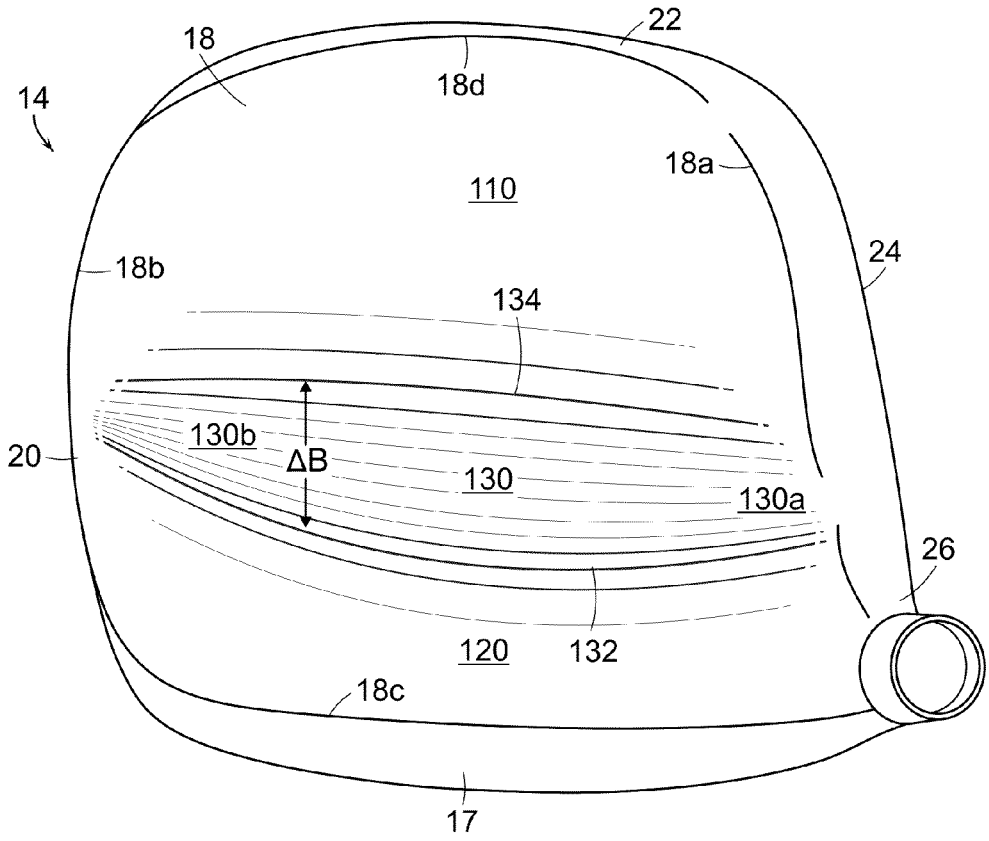
Figure 13D:
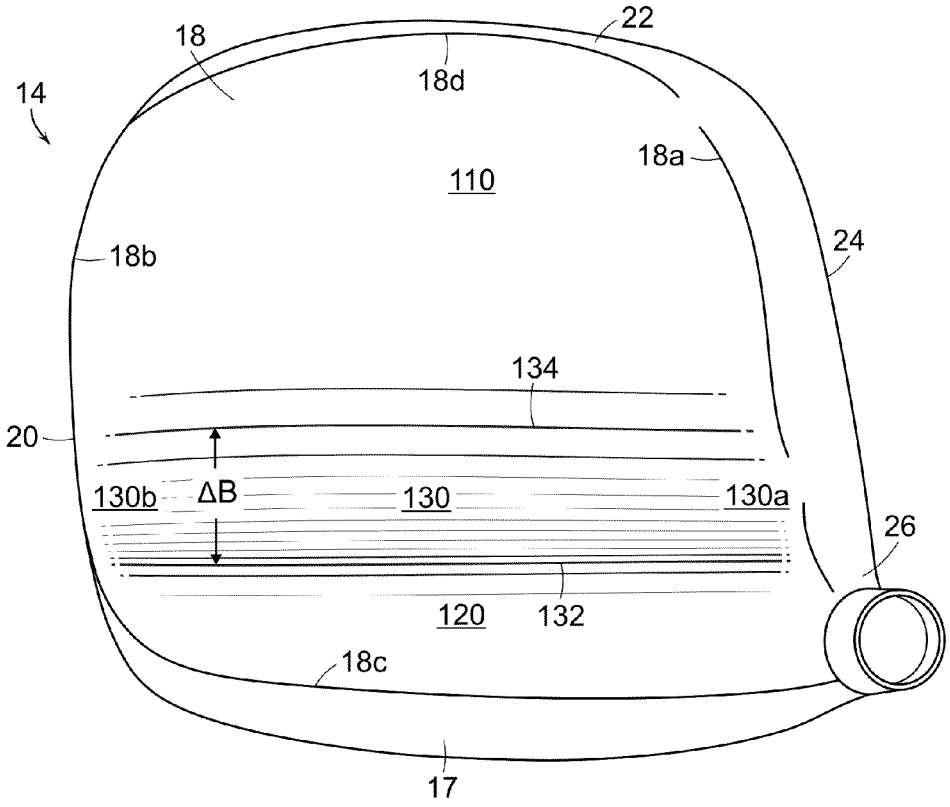

According to other aspects and as generally shown in FIG. 13C, the breadth dimension ($\Delta B_C$) of the crown transition region 130 may decrease along its length from the heel-side end 130*a* to the toe-side end 130*b*. According to some embodiments, the breadth dimension ($\Delta B_C$) of the crown transition region 130 at the toe-side end 130*b* may be less than or equal to approximately 50%, approximately 30% or even approximately 20% of the maximum breadth (B) of the club head 14. According to even other embodiments and as generally shown in FIG. 13D, the breadth dimension ($\Delta B_C$) of the crown transition region 130 may be generally constant along its length from the heel-side end 130*a* to the toe-side end 130*b*. The maximum breadth dimension ($\Delta B_{CMAX}$) of the crown transition region 130 may range from approximately 5 to approximately 40 mm. Alternatively, the maximum breadth dimension ($\Delta B_{CMAX}$) of the crown transition region 130 may be less than or equal to 25 mm.

As noted above, in certain embodiments (see e.g., FIGS. 13A and 13B), the crown transition region 130 need not extend completely across the crown 18 from the heel-side to the toe-side. Thus, for example, at its toe-side end 130*b* the crown transition region 130 may smoothly merge into the substantially horizontally-oriented surface of the crown 18. As shown in FIG. 13A, beyond the toe-side end 130*b*, the crown 18 adjacent to the toe may be configured without any transition region formed between the forward crown region 120 and the rearward crown region 110. According to this aspect, beyond the toe-side end 130*b* of the crown transition region 130, the surface of the crown 18 forms a smooth convex surface devoid of any transition features and having a slope less than 1.0. In particular, the surface of the crown 18 beyond the toe-side end 130*b* of the crown transition region 130 may be free of any inflection points (as discussed below) and may be free of any forward and/or rearward crown transition features. Similarly, as schematically illustrated in FIG. 13B, to the heel side of the heel-side end 130*a*, the surface of the crown 18 may be configured without any transition region formed between the forward crown region 120 and the rearward crown region 110. In contrast, according to other embodiments, the crown transition region 130 may extend all the way across the crown 18 as schematically shown in FIGS. 13C and 13D. In the particular embodiments of FIGS. 13C and 13D the crown transition region 130 extends from the heel-to-crown transition feature 18*a* to the toe-to-crown transition feature 18*b*.

Figure 3:
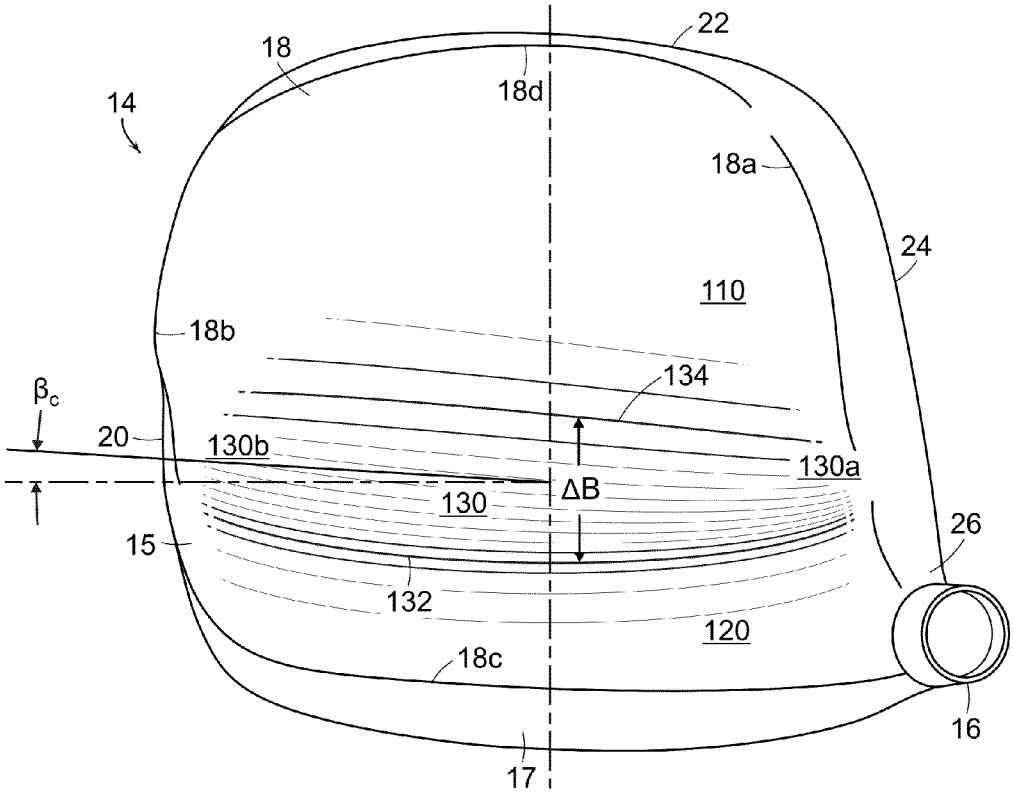
FIG. 3 is schematic top plan view of a golf club according to certain aspects.
Figure 13E:
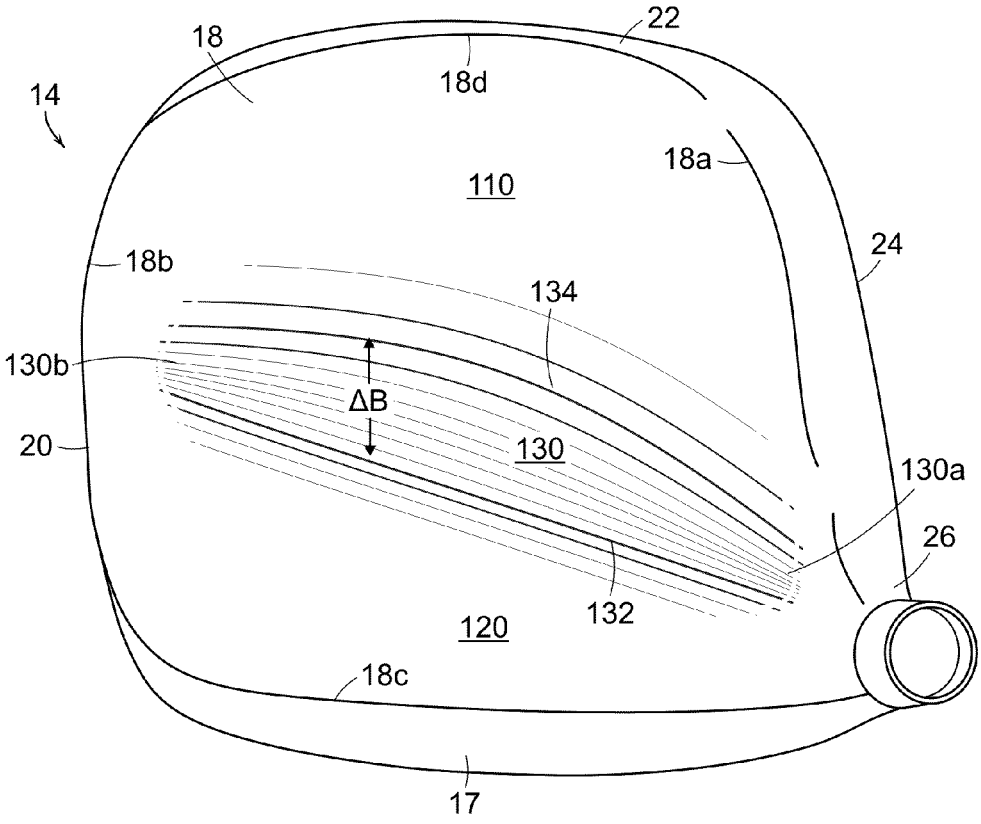

The crown transition region 130, as viewed from above, may be angled toward the rear 22 and away from the front plane as it extends away from the heel 24. Referring to FIG. 9 and as described in more detail below, a top-view orientation angle of the crown transition region 130 is referred to by the symbol $\beta_C$. In the embodiment of FIGS. 3-8, as best shown in FIG. 3, the transition region 130 may be generally oriented at a relatively shallow angle $\beta_C$ from the front plane. Indeed, referring to FIG. 13D, it can be seen that the crown transition region 130 may be generally oriented at an angle substantially parallel to the front plane. Referring to FIG. 13E, it can be seen that the crown transition region 130 may be generally oriented at a considerably larger angle from the front plane, i.e., at an angle greater than 10°, at an angle greater than 20°, or even at an angle greater than 30° from the front plane. According to certain aspects, the crown transition region 130 may be angled from approximately 0° to approximately 45° from the front plane. Other preferred orientations of the transition region 130 may be at an angle from approximately 0° to approximately 30°, at an angle from approximately 5° to approximately 20°, or even at an angle from approximately 5° to approximately 15° from the front plane.

As best shown in FIG. 11B and FIG. 14B, when viewed from a perpendicular to the centerline of the club head 14 (i.e., when viewed from the side of the club head 14), the surface profile of the crown transition region 130 may be described as being generally "S-shaped." This S-shape surface profile is due to the presence of an inflection point 130*c*. For purposes of the present disclosure, the term "inflection point" refers to a point on a surface profile of the crown transition region 130 at which the change in curvature changes sign, i.e., where the second derivative changes sign. In other words, the inflection point 130*c* is the point on the curve at which the surface profile changes from being concave downward to concave upward, or vice versa. Even more simply, the inflection point 130*c* is where the tangent to the surface profile crosses the curve.

By way of a non-limiting example, a majority of the surface of the crown transition region 130 may have a convex surface profile. On the other side of the inflection point 130*c*, the crown transition region 130 may have a concave surface profile. In some embodiments, a majority of the surface of the crown transition region 130 may have a concave surface profile. As another option, a majority of the surface of the transition region 130 may have a relatively planar surface profile (see e.g., FIGS. 14A and 14C).

Further, for purposes of this disclosure and referring back to FIGS. 9-12, features of the club head 14 may be defined by the transitions of the surfaces from a substantially vertically-oriented surface to a substantially horizontally-oriented surface. Thus, a heel-to-crown transition feature 18*a* may be defined within a heel-to-crown transition region, i.e., where the heel surface and the crown surface merge. With the club head in the 60-degree lie angle position, and referring to FIG. 12, the heel-to-crown transition feature 18*a* may be defined as that portion of the merged heel-to-crown surface wherein a tangent (Tangent A), drawn in a vertical plane that is parallel to the front plane, is at an angle of 45 degrees to the horizontal. Thus, the heel-to-crown transition feature 18*a* may demarcate where a vertically-oriented heel geometry merges with a horizontally-oriented crown geometry. (A substantially horizontally-oriented surface is defined as having a normal to the surface that has an angle to the horizontal of greater than 45 degrees. A substantially vertically-oriented surface is defined as having a normal to the surface that has an angle to the horizontal of less than 45 degrees.) The heel-to-crown transition feature 18*a* may be considered to be part of the crown 18, part of the heel 24, or part of both the crown 18 and the heel 24. The heel-to-crown transition feature 18*a* may be seen when the club head is viewed from above (see FIG. 9).

Figure 12:
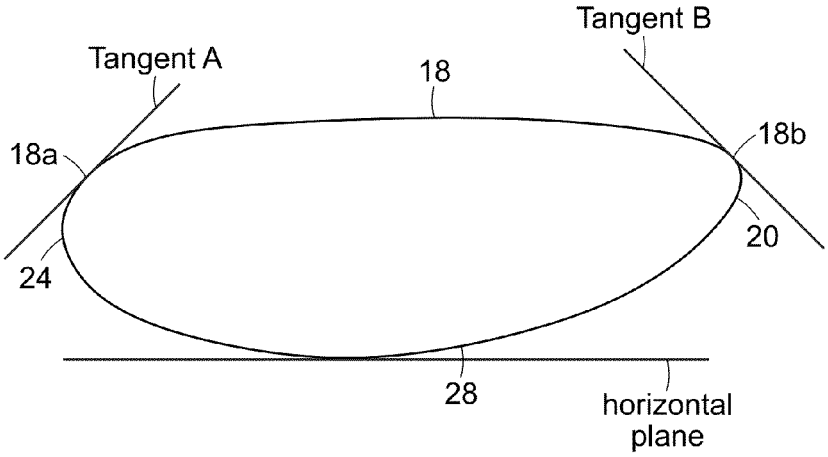
FIG. 12 is a schematic of a surface profile taken along section XII-XII of the club head of FIG. 9 illustrating certain club head parameters. Section XII-XII is parallel to the front plane of the club head.

Similarly, still referring to FIGS. 9-12, a toe-to-crown transition feature 18*b* may be defined within the toe-to-crown transition region, i.e., where the toe surface and the crown surface merge. Referring in particular to FIG. 12, the toe-to-crown transition feature 18*b* may be defined as that portion of the merged toe-to-crown surface wherein a tangent (Tangent B), drawn in a vertical plane that is parallel to the front plane, is at an angle of 45 degrees to the horizontal. Thus, the toe-to-crown transition feature 18*b* may demarcate where the vertically-oriented toe geometry merges with the horizontally-oriented crown geometry. The toe-to-crown transition feature 18*b* may be considered to be part of the crown 18, part of the toe 20, or part of both the crown 18 and the toe 20. The toe-to-crown transition feature 18*b* may be seen when the club head is viewed from above (see FIG. 9).

Now referring to FIG. 9 and FIGS. 11A-11B, a front-to-crown transition feature 18*c* may be defined within the front-to-crown transition region, i.e., where the front surface and the crown surface merge. The front-to-crown transition feature may be defined as that portion of the merged front-to-crown surface wherein a tangent (Tangent C), drawn in a vertical plane that is perpendicular to the front plane, is at an angle of 45 degrees to the horizontal. Thus, the front-to-crown transition feature 18*c* may demarcate where the vertically-oriented front geometry merges with the horizontally-oriented crown geometry. The front-to-crown transition feature 18*c* may be considered to be part of the crown 18, part of the front 17, or part of both the crown 18 and the front 17. The front-to-crown transition feature 18*c* may be seen when the club head is viewed from above (see FIG. 9).

Even further and again referring to FIGS. 9 and 11, a rear-to-crown transition feature 18*d* may be defined within the rear-to-crown transition region, i.e., where the rear surface and the crown surface merge. The rear-to-crown transition feature 18*d* may be defined as that portion of the merged rear-to-crown surface wherein a tangent (Tangent D), drawn in a vertical plane that is perpendicular to the front plane, is at an angle of 45 degrees to the horizontal. Thus, the rear-to-crown transition feature 18*d* may demarcate where the vertically-oriented rear geometry merges with the horizontally-oriented crown geometry. The rear-to-crown transition feature 18*d* may be considered to be part of the crown 18, part of the rear 22, or part of both the crown 18 and the rear 22. The rear-to-crown transition feature 18*d* may be seen when the club head is viewed from above (see FIG. 9).

Thus, generally, the crown 18 may be considered to extend front-to-rear between the front-to-crown transition feature 18*c* and the rear-to-crown transition feature 18*d*, and further to extend side-to-side between the heel-to-crown transition feature 18*a* and the toe-to-crown transition feature 18*b*.

Referring to FIG. 9 and FIGS. 11A and 11B, the crown transition region 130 may be defined by its forward and lower transition features 132, 134, i.e., where the crown surfaces adjacent to the transition region 130 transition from the substantially vertically-oriented surface of the transition region 130 to the substantially horizontally-oriented surfaces of the forward crown region 120 and the rearward crown region 110. Thus, at its forward, forward edge the crown transition region 130 may be delimited by a forward crown transition feature 132. The forward crown transition feature 132 is located where the surface of the forward crown region 120 and the surface of the crown transition region 130 merge. The surface of this merging area typically would have a generally convex curvature, when viewed from a perpendicular to the centerline of the club head 14, as shown for example in FIGS. 11A and 11B. More specifically, the forward crown transition feature 132 may be defined as that portion of the merged surface wherein a tangent to the merged surface (Tangent E), drawn in a vertical plane that is parallel to the centerline, is at an angle of 45 degrees to the horizontal (see FIGS. 11A and 11B). Thus, the forward crown transition feature 132 may demarcate where the more vertically-oriented geometry of the crown transition region 130 transitions to the more horizontally-oriented geometry of the forward crown region 120. The forward crown transition feature 132 may be considered to be part of the forward crown region 120, part of the crown transition region 130, and/or part of both the forward crown region 120 and the crown transition region 130. The forward crown transition feature 132 may be seen when the club head is viewed from above (see e.g., FIG. 3). Further, the forward crown transition 132 feature may be visible when the club head is viewed from the heel-side of the club head 14 and/or from the back of the club head 14.

Referring back to FIG. 9 and FIGS. 11A-11B, the forward crown transition feature 132 may extend from the heel 24 toward the toe 20. Further, as with the crown transition region 130, the forward crown transition feature 132 extends across the centerline of the club head 14. Thus, by way of non-limiting examples, the forward crown transition feature 132 may extend from proximate the heel 24 to the toe 20, from the heel-to-crown transition feature 18*a* toward the toe 20, or even from the heel-to-crown transition feature 18*a* to the toe-to-crown transition feature 18*b*. Referring to FIGS. 13A-13E, and particularly to FIGS. 13D and 13E, according to certain embodiments, at least a portion of the forward crown transition feature 132 may extend from the heel 24 toward the toe 20 in an approximately straight line, when viewed from above. Alternatively, the forward crown transition feature 132 may have a slight curvature, when viewed from above. For example, the forward crown transition feature 132 may have a slightly concave curvature (see e.g., FIG. 13A).

Referring to FIG. 9, the forward crown transition feature 132 may extend toward the toe 20 at an angle $\alpha$ from a front plane of the club head, when viewed from above. As the forward crown transition feature 132 extends from the heel toward the toe, the angle $\alpha$ may change, i.e., the forward crown transition feature 132 may be curved. For purposes of this disclosure, when the forward crown transition feature 132 is curved when viewed from above, a centerline angle $\alpha_c$ may be defined as the angle of the tangent to the transition feature 132 taken where the transition feature 132 crosses the centerline of the club head 14. According to certain embodiments, the forward crown transition feature 132 may extend toward the toe 20 at a centerline angle $\alpha_c$ of from −5 degrees to 25 degrees, from 0 degrees to 25 degrees, from 0 degrees to 15 degrees, from 0 degrees to 10 degrees, or even at an angle of less than or equal to 5 degrees, from a front plane of the club head, when viewed from above.

Referring to FIG. 9 and FIGS. 11A-11B, at its lower edge the crown transition region 130 may be delimited by a rearward crown transition feature 134. The rearward crown transition feature 134 is located where the surface of the rearward crown region 110 and the surface of the crown transition region 130 merge. The surface of this merging area has a generally concave curvature, when viewed from a perpendicular to the centerline of the club head 14, as shown for example in FIGS. 11A and 11B. The rearward crown transition feature 134 may be defined as that portion of the merged surface wherein a tangent to the surface (Tangent F), drawn in a vertical plane that is perpendicular to the front plane, is at an angle of 45 degrees to the horizontal (see FIGS. 11A and 11B). Thus, similar to the forward crown transition feature 132, the rearward crown transition feature 134 may demarcate where the more vertically-oriented geometry of the crown transition region 130 transitions to the more horizontally-oriented geometry of the rearward crown region 110. The rearward crown transition feature 134 may be considered to be part of the rearward crown region 110, part of the crown transition region 130, or part of both the rearward crown region 110 and the crown transition region 130. In general, the rearward crown transition feature 134 may be visible when the club head 14 is viewed from above (see FIGS. 3 and 9). Further, the rearward crown transition feature 134, or some portion thereof, may be visible when the club head is viewed from the back (see FIG. 7).

Referring back to FIGS. 3 and 9, the rearward crown transition feature 134 may extend from the heel 24 toward the toe 20. Further, as with the crown transition region 130, the rearward crown transition feature 134 extends across the centerline of the club head 14. Thus, by way of non-limiting examples, the rearward crown transition feature 134 may extend from proximate the heel 24 to the toe 20, from the heel-to-crown transition feature 18*a* toward the toe 20, or even from the heel-to-crown transition feature 18*a* to the toe-to-crown transition feature 18*b*. Referring to FIGS. 13A-13E, and particularly to FIGS. 13D and 13E, according to certain embodiments, at least a portion of the rearward crown transition feature 134 may extend from the heel 24 toward the toe 20 in an approximately straight line, when viewed from above. Alternatively, the rearward crown transition feature 134 may have a slight curvature, when viewed from above. For example, the rearward crown transition feature 134 may have a slightly convex curvature (see e.g., FIG. 13E).

Referring back to FIG. 9, the rearward crown transition feature 134 may extend toward the toe 20 at an angle $\gamma$ from the front plane of the club head 14, when viewed from above. As the rearward crown transition feature 134 extends from the heel toward the toe, the angle $\gamma$ may change, i.e., the rearward crown transition feature 134 may be curved. For purposes of this disclosure, when the rearward crown transition feature 134 is curved when viewed from above, a centerline angle $\gamma_c$ may be defined as the angle of the tangent to the transition feature 134 taken where the transition feature 134 crosses the centerline of the club head 14. According to certain embodiments, the rearward crown transition feature 134 may extend toward the toe 20 at an angle $\gamma_c$ of from 0 degrees to 45 degrees, from 0 degrees to 30 degrees, from 0 degrees to 20 degrees, from 0 degrees to 15 degrees, or even at an angle of less than or equal to 10 degrees, from the front plane of the club head 14, when viewed from above.

The crown transition region 130, itself, when viewed from above, may be angled toward the rear 22 and away from the front plane (or from the ball striking face 17) as it extends away from the heel 24. The degree of angling (i.e., the top-view orientation) of the crown transition region 130 may be characterized by taking the average of the centerline angle $\alpha_C$ of the forward crown transition feature 132 and the centerline angle $\gamma_C$ of the rearward crown transition feature 134. Referring to FIG. 9, this orientation angle of the crown transition region 130 is referred to by the symbol $\beta_C$, wherein $\beta_C=\frac{1}{2}(\alpha_C+\gamma_C)$. In the embodiment of FIGS. 3-8, as best shown in FIG. 3, the crown transition region 130 may be generally oriented at an angle $\beta_C$ of from between 5 and 15 degrees. According to certain aspects, the crown transition region 130 may have a top-view orientation angle $\beta_C$ of approximately 0° (see e.g., FIG. 13D), approximately 5°, approximately 10°, approximately 15°, approximately 20°, approximately 25° (see e.g., FIG. 13E), or even up to approximately 30° from the front plane. Thus, for example, preferred orientations of the characteristic angle $\beta_c$ of the crown transition region 130 may range from approximately 0° to approximately 20°, from approximately 5° to approximately 20°, or even from approximately 5° to approximately 15° from the front plane. Thus, by way of non-limiting examples, FIGS. 13A-13E schematically illustrate various orientations for exemplary crown transition regions 130, as viewed from above.

According to certain aspects, the forward crown region 120 may have a centerline breadth dimension (measured from the face-to-crown transition feature 18*c* to the forward crown transition feature 132 in the vertical plane of the centerline) that is greater than or equal to approximately 30%, greater than or equal to approximately 40%, greater than or equal to approximately 45%, or even greater than or equal to approximately 50% of the maximum breadth (B) of the club head 14. According to other aspects, the rearward crown region 110 may have a centerline breadth dimension (measured from rear-to-crown transition feature 18*d* to the rearward crown transition feature 134 in the vertical plane of the centerline) that is greater than or equal to approximately 30%, greater than or equal to approximately 40%, greater than or equal to approximately 45%, or even greater than or equal to approximately 50% of the maximum breadth (B) of the club head 14.

According to even other aspects, the rearward crown region 110 may have a centerline height (measured in the vertical plane of the centerline when the club is in the 60 degree lie angle position) that less than or equal to approximately 70%, less than or equal to approximately 60%, less than or equal to approximately 50%, or even less than or equal to approximately 40% of the maximum height (H) of the club head 14. It may be preferable to have the centerline height of the rearward crown region 110, measured along the centerline of the club head from the rearward crown transition feature 134 to the rear-to-crown transition feature 18*d*, range from approximately 40% to approximately 60%, or even from approximately 45% to approximately 55%, of the maximum height (H) of the club head 14. Optionally, it may be preferable to have the centerline height of the rearward crown region 110, measured along the centerline of the club head from the rearward crown transition feature 134 to the rear-to-crown transition feature 18*d*, vary by no more than approximately ±10% or even by no more than approximately ±5%.

The forward crown region 120 provides a smooth surface for air encountering the ball striking face 17 to flow up and over, particularly when the ball striking face 17 is leading the swing. The rearward crown region 110 provides a smooth surface on the crown 18 for air encountering the heel 24 to flow up and over, particularly when the heel 24 is leading the swing. The crown transition region 130 allows the forward crown region 120 to be at a different, greater height than the rearward crown region 110. Thus, advantageously, the height of the front body portion 15*a* of the club head 14 may be designed quasi-independently from the height of the aft body portion 15*b* of the club head 14. This may allow for a greater height of the ball striking face 17, while allowing a cross-sectional area of the heel 24 to be reduced to provide greater aerodynamic streamlining for air flowing over the heel 24.

Because the crown transition region 130 steps down to the rearward crown region 110 from the forward crown region 120, the body member 15 may be generally "flattened" as compared to other, more conventional, club heads. Thus, the flattened body member 15 of the present club head 14 may have a greater length (L) and/or breadth (B) than club heads having similar volumes. By way of non-limiting example, the club head breadth (B) may be greater than or equal to approximately 11.5 cm, or even greater than or equal to approximately 12.0 cm. Similarly, by way of non-limiting example, the club head length (L) may be greater than or equal to approximately 11.5 cm, or even greater than or equal to approximately 12.0 cm. Additionally, it is expected that the "flattening" of the club head relative to club heads having the same volume may result in the height of the center of gravity (CG) of the club head 14 being less than or equal to approximately 2.0 cm, less than or equal to approximately 1.75 cm, or even less than or equal to approximately 1.5 cm. Because of the increase breadth, the distance of the center of gravity (CG) from the front plane of the club head 14 may be greater than or equal to approximately 3.0 cm, greater than or equal to approximately 3.5 cm, or even greater than or equal to approximately 4.0 cm.

Further, it is expected that the "flattening" of the club head relative to club heads having the same volume will allow for a more streamlined club head with improved moment-of-inertia (MOI) characteristics. For example, it is expected that the moment-of-inertia (Izz) around a vertical axis associated with the club head's center-of-gravity may be greater than 3100 g-cm$^2$, greater than 3200 g-cm$^2$, or even greater than 3300 g-cm$^2$ for square-head type club heads. Further, it is expected that the moment-of-inertia (Ixx) around a horizontal axis associated with the club head's center-of-gravity may be greater than 5250 g-cm$^2$, greater than 5350 g-cm$^2$, or even greater than 5450 g-cm$^2$ for square-head type club heads. The vertical (z) axis and the horizontal (x) axis are defined with the club head in the 60° lie angle position (see FIGS. 10A and 10B).

Figure 15:
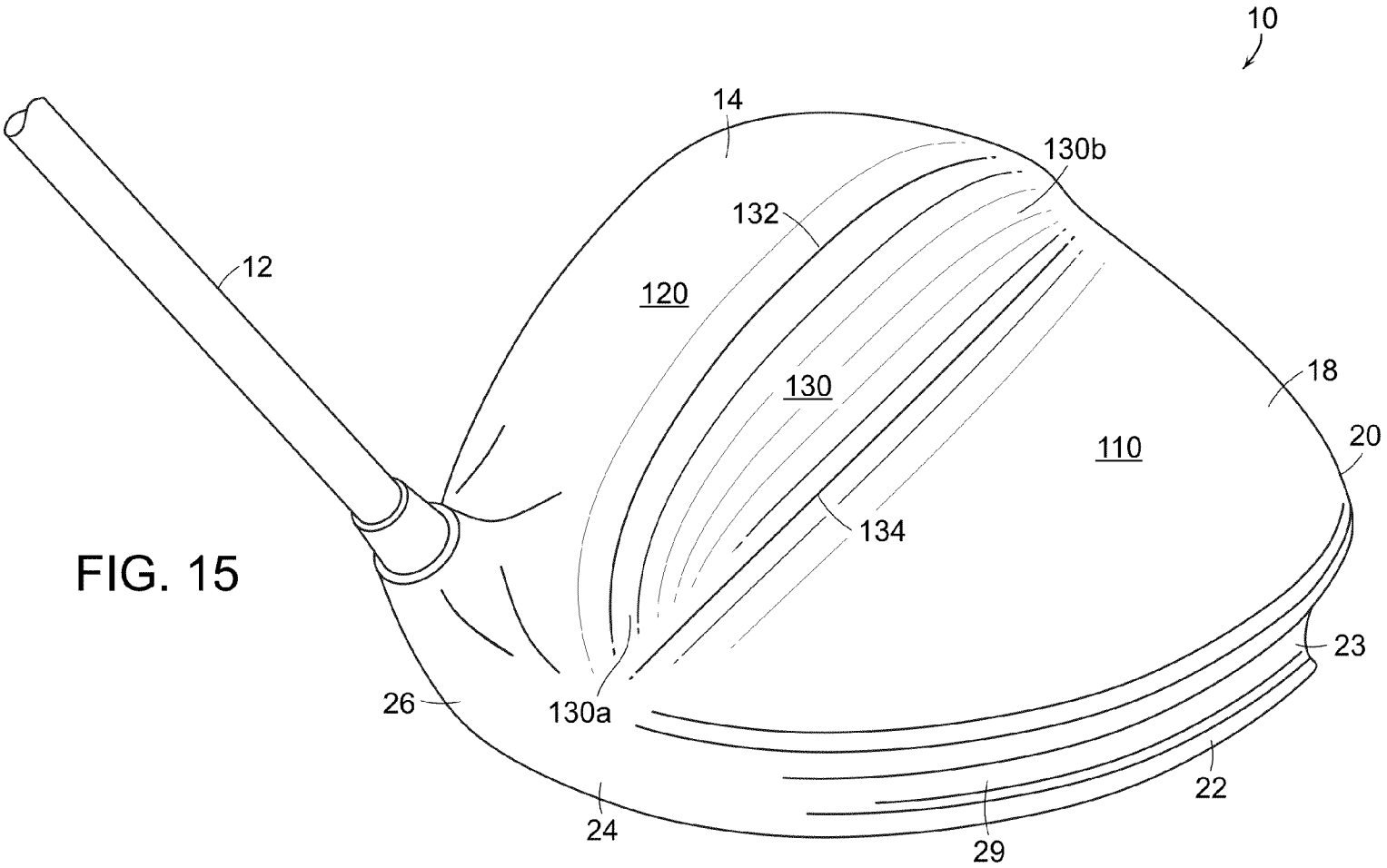
FIG. 15 is a schematic perspective view of a club head, generally viewed from the top heel side, according to another aspect.

According to even further aspects and as shown, according to one embodiment, in FIG. 15, the club head 14 may include a "Kammback" feature 23. The Kammback feature 23 may extend across at least a portion of the rear 22 from the heel 24 to the toe 20 and/or that extends across at least a portion of the toe 20 from the rear 22 to the ball striking face 17. Further, as shown in FIG. 15, the Kammback feature 23 may extend into the heel 24.

Generally, Kammback features are designed to take into account that a laminar flow, which could be maintained with a very long, gradually tapering, downstream (or trailing) end of an aerodynamically-shaped body, cannot be maintained with a shorter, tapered, downstream end. When a downstream tapered end would be too short to maintain a laminar flow, drag due to turbulence may start to become significant after the downstream end of a club head's cross-sectional area is reduced to approximately fifty percent of the club head's maximum cross section. This drag may be mitigated by shearing off or removing the too-short tapered downstream end of the club head, rather than maintaining the too-short tapered end. It is this relatively abrupt cut off of the tapered end that is referred to as the Kammback feature 23.

It is known that during a significant portion of the golfer's downswing the heel 24 and/or the hosel region 26 lead the swing. During these portions of the downswing, either the toe 20, portion of the toe 20, the intersection of the toe 20 with the rear 22, and/or portions of the rear 22 form the downstream or trailing end of the club head 14. Thus, the Kammback feature 23, when positioned along at least a portion of the toe, at the intersection of the toe 20 with the rear 22, and/or along at least a portion of the rear 22 of the club head 14, may be expected to reduce turbulent flow, and therefore reduce drag due to turbulence, during these portions of the downswing.

According to certain aspects, the Kammback feature 23 may include a continuous channel or groove 29 formed about a portion of a periphery of club head 14. As illustrated in FIG. 15, groove 29 extends along a portion of the toe 20, along the entirety of the rear 22, and then along a portion of the heel 24. As can be seen in FIG. 15, groove 29 may have a tapered end.

Figure 16:
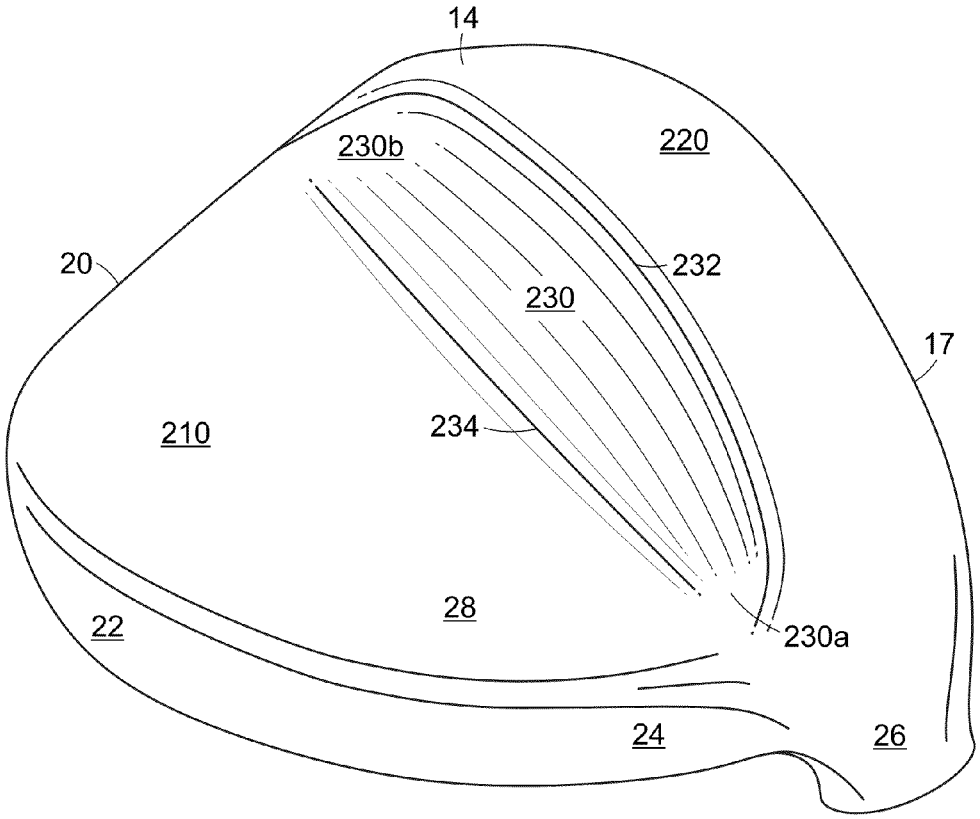
FIG. 16 is a schematic perspective view of a club head, generally viewed from the bottom heel side, according to even another aspect.
Figure 17:
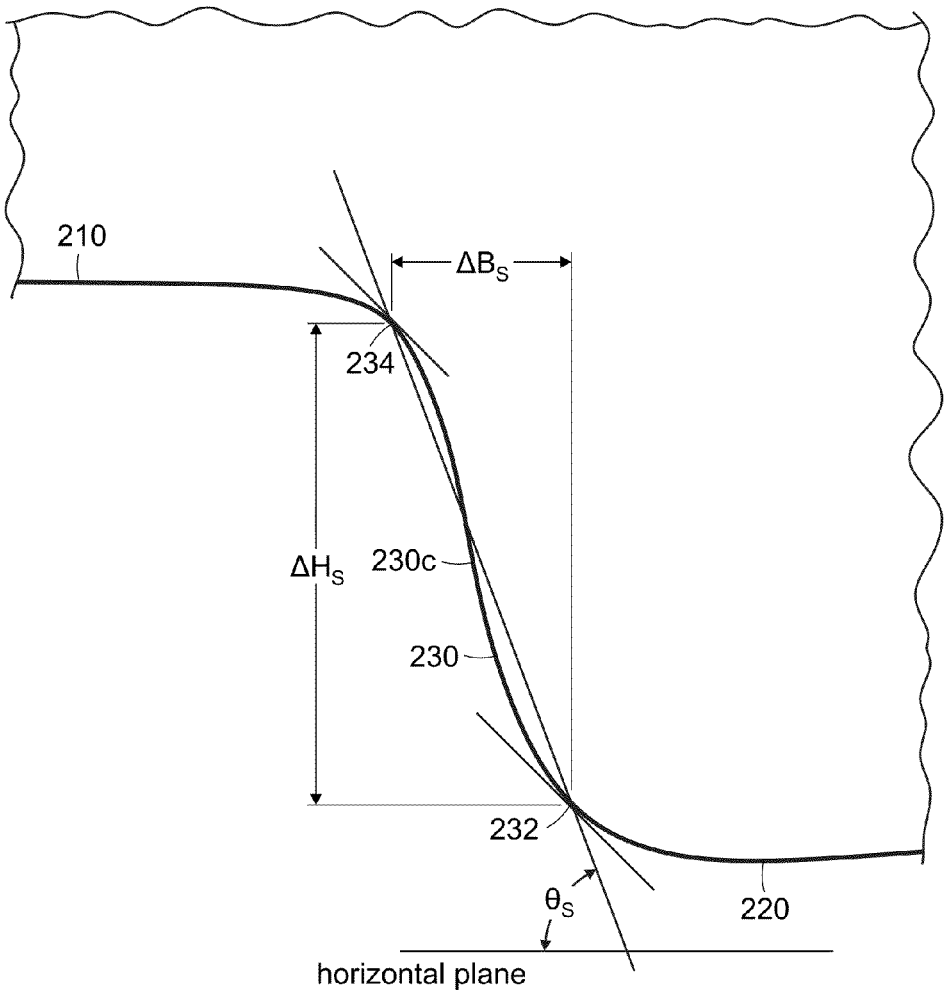
FIG. 17 is a schematic of an enlarged portion of a sole surface profile taken along a centerline of the embodiment of FIG. 16, particularly showing details of the sole transition region.

Another illustrative embodiment of a golf club according to aspects of the invention is shown in FIGS. 16 and 17. As can generally be seen in FIG. 16, the bottom or sole of the club head may be provided with an elongated feature, generally extending from the heel toward the toe, which separates a front or forward sole region from a rear or rearward sole region. This elongated feature on the sole, similar to the elongated feature on the crown described above, provides a transition region, wherein the height of the forward sole region is stepped down or transitioned to the height of the rearward sole region. By transitioning the height of the sole from the front or forward sole region to the rear or rearward sole region, it is expected that air flowing over and/or under the club head from the heel toward the toe will encounter less resistance. Thus, it is expected that the transition region will result in reduced drag over the course of the golfer's downswing, higher club head speed at the moment of impact with the golf ball, and increased travel distance of the golf ball.

Thus, according to this aspect of the invention, and referring to FIG. 16, another drag-reducing structure, similar to crown transition region 130, may be provided on the sole 28. A generally elongated sole transition region 230 is located between the forward sole region 220 and the rearward sole region 210. The sole transition region 230 may be formed as an aerodynamically smooth, continuous surface that extends in the heel-to-toe direction. The relatively smooth extent of the sole transition region 230 in the heel-to-toe direction is expected to assist in the maintenance of a laminar boundary layer over the sole 18 (particularly when the heel 24 leads the swing). The sole transition region 230, particularly in combination with a reduced profile presented by the club head 14 due to the reduced sole region 210, is expected to provide a more aerodynamically efficient club head 14.

The sole transition feature 230 is provided with many of the characteristics of the crown transition region 130. Thus, for purposes of this disclosure, the above explanation of the characteristics of the crown transition region 130 may be applied to the sole transition region 230. Characteristics of the crown transition feature 130 generally are associated with items number 1xx, while similar characteristics of the sole transition region 230 are generally associated with item numbers 2xx.

Thus, for example, the sole transition region 230 generally extends from the heel 24 toward the toe 20 such that the sole transition region 230 may be generally oriented in a heel-to-toe direction. Further, the sole transition region 230 extends across the centerline of the club head 14.

Thus, as shown in FIG. 16, the sole transition region 230 may be a generally elongated feature that extends from a heel-side end 230*a* to a toe-side end 230*b*. The sole transition region 230 is bounded along its forward sole edge by an forward sole transition feature 232 and along its rearward sole edge by a rearward sole transition feature 234. Thus, the heel-side end 230*a* and the toe-side end 230*b* are also bounded by the forward and rearward sole transition features 232, 234.

As shown in FIG. 17, the sole transition region 230 may provide a relatively vertically-oriented sole surface extending between the relatively horizontally-oriented surface of the forward sole region 220 and the relatively horizontally-oriented surface of the rearward sole region 210. The transition from the forward sole region 220 to the rearward sole region 210 may be provided as a gradual transition between the forward sole transition feature 232 and the rearward sole transition feature 234. Alternatively, the sole transition region 230 may provide a more abrupt transition from the forward sole region 220 to the rearward sole region 210. The abruptness of the transition may be represented by the slope of the sole transition region 230, i.e., the ratio of the change in height ($\Delta H_S$) of the sole transition region 230 to the change in breadth ($\Delta B_S$) of the sole transition region 230. Generally, the sole transition region 230 would be provided as a smooth transition, i.e., the transition surface would not include sharp corners or jagged features.

The slope ($\Delta H_S/\Delta B_S$) of the sole transition region 230 may vary as the transition region in the sole 28 extends from the heel towards the toe. By way of non-limiting example, the sole transition region 230 may be steepest at its heel-side end 230*a*, and progressively less steep as it extends toward the toe 20. Thus, the sole transition region 230 may have a slope ($\Delta H_S/\Delta B_S$) that decreases monotonically as it extends from the heel 24 toward the toe 20. As another non-limiting example, the sole transition region 230 may be steepest in its central region and progressively less steep as it extends toward the heel 24 and towards the toe 20. Thus, for example, the slope ($\Delta H_S/\Delta B_S$) of the sole transition region 230 at the centerline may be less than or equal to approximately 80% of the slope ($\Delta H_S/\Delta B_S$) of the sole transition region 230 at the heel-side end 230*a*. Alternatively, the slope ($\Delta H_S/\Delta B_S$) of the sole transition region 230 at the centerline may be less than or equal to approximately 70%, less than or equal to approximately 60%, less than or equal to approximately 50%, or even less than or equal to approximately 40% of the slope ($\Delta H_S/\Delta B_S$) of the sole transition region 230 at the heel-side end 230*a*.

Alternatively, the maximum slope of the sole transition region 230 need not be at the heel-side end 230*a*. Thus, by way of other non-limiting examples, the slope ($\Delta H_S/\Delta B_S$) of the sole transition region 230 at the centerline may be less than or equal to approximately 80%, less than or equal to approximately 70%, less than or equal to approximately 60%, less than or equal to approximately 50%, or even less than or equal to approximately 40% of the maximum slope of the sole transition region 230. Further, the slope ($\Delta H_S/\Delta B_S$) of the sole transition region 230 at the centerline may range from approximately 30% to approximately 80%, from approximately 30% to approximately 70%, from approximately 30% to approximately 60%, or even from approximately 50% to approximately 80% of the maximum slope of the sole transition region 230.

Similar to the various embodiments of the crown transition features 130 schematically illustrated in FIGS. 14A-14D, the sole transition feature 230 may also be provided with various surface profiles. Thus, according to some aspects, the slope ($\Delta H_S/\Delta B_S$) of the sole transition region 230 may be equal to approximately 1.0. According to other aspects, the slope ($\Delta H_S/\Delta B_S$) may be greater than approximately 1.0, greater than approximately 1.3, or greater than approximately 1.6. These slopes ($\Delta H_S/\Delta B_S$) would generally be considered to be relatively moderate transitions. According to even other aspects, the slope ($\Delta H_S/\Delta B_S$) may be greater than approximately 2, greater than approximately 4, approximately vertical, or may even become negative (i.e., when the sole transition region 230 folds back under the forward sole region 220). These slopes ($\Delta H_S/\Delta B_S$) would generally be considered to be abrupt transitions.

At the centerline of the club head 14 and referring to FIG. 17, the height dimension $\Delta H_S$ of the sole transition region 230 may range from approximately 2 mm to approximately 20 mm. More preferably, the centerline height dimension $\Delta H_S$ of the sole transition region 230 may range from approximately 2 mm to approximately 15, from approximately 2 mm to approximately 10, or even from approximately 2 mm to approximately 5. For relatively shallow sole transition regions 230 the centerline height dimension $\Delta H_S$ may be less than or equal to 5 mm; for relatively deep sole transition regions 230 the centerline height dimension $\Delta H_S$ may be greater than or equal to 15 mm.

Further, at the centerline of the club head 14, the breadth dimension $\Delta B_S$ of the sole transition region 230 may range from approximately 5 mm to approximately 30 mm. More preferably, the breadth dimension $\Delta B_S$ of the sole transition region 230 at the centerline may range from approximately 5 mm to approximately 25, from approximately 5 mm to approximately 20, or even from approximately 5 mm to approximately 15. For relatively narrow sole transition regions 230, the breadth dimension $\Delta B_S$ at the centerline may be less than or equal to 10 mm; for relatively broad sole transition regions 230, the breadth dimension $\Delta B_S$ at the centerline may be greater than or equal to 15 mm. According to other aspects, the breadth dimension $\Delta B_S$ of the sole transition region 230 at the centerline may be less than or equal to approximately 25%, approximately 20%, approximately 15%, approximately 10%, or even approximately 5% of the maximum breath B of the club head 14. Similar to the corresponding feature of the crown transition region 130, the sole transition region 230 may be limited to the middle 50% of the total breadth (B) of the club head 14.

Further, similar to the corresponding feature of the crown transition region 130, the height $\Delta H_S$ of the sole transition region 230 may vary as the sole transition region 230 extends away from the heel 24. The height dimension $\Delta H_S$ of the sole transition region 230 may be measured in any vertical plane that is parallel to the centerline of the club head 14. In the illustrative embodiment shown best in FIG. 16, the height of the sole transition region 230 initially increases as the region 230 extends away from the heel-side end 230*a*, then stays relatively constant until it crosses the centerline of the club head 14, and finally decreases as the region approaches the toe-side end 230*b*. Thus, by way of non-limiting examples, the height dimension $\Delta H_S$ of the sole transition region 230 at the heel-side end 230*a* and/or at the toe-side end 230*b* may be less than the height dimension of the sole transition region at the centerline. By way of non-limiting example, the maximum height dimension $\Delta H_S$ of the sole transition region 230 may range from approximately 2 to approximately 20 mm. Alternatively, the maximum height dimension $\Delta H_S$ of the sole transition region 230 may be less than or equal to 10 mm.

Further, according to another aspect, the sole transition region 230 may be provided with a fairly constant height dimension $\Delta H_S$. Thus, by way of non-limiting examples, the difference between the maximum height dimension and the minimum height dimension of the sole transition region 230 may be less than or equal to approximately 6 mm, less than or equal to approximately 4 mm, or even less than or equal to less than approximately 2 mm.

Similar to the corresponding feature of the crown transition region 130, the sole transition region 230 may change in breadth as the sole transition region 230 extends away from the heel 24. The breadth dimension $\Delta B_S$ of the sole transition region 230 may be measured in any vertical plane that is parallel to the centerline of the club head 14. The breadth dimension $\Delta B_S$ of the sole transition region 230 initially increases as the region 230 extends away from the heel-side end 230*a* until it crosses the centerline of the club head 14 and then decreases as the transition region 230 approaches the toe-side end 230*b*. Thus, by way of non-limiting example, the breadth dimension $\Delta B_S$ of the sole transition region 230 at the heel-side end 230*a* may be less than the breadth dimension $\Delta B_S$ of the sole transition region 230 at the centerline. Even further, the breadth dimension $\Delta B_S$ of the sole transition region 230 at the heel-side end 230*a* may be less than at the centerline and the breadth dimension $\Delta B_S$ at the centerline may be less than the breadth dimension $\Delta B_S$ of the sole transition region at the toe-side end 130*b*. In other words, according to some embodiments, the breadth dimension $\Delta B_S$ of the sole transition region 230 may increase along its length from the heel-side end 230*a* to the toe-side end 230*b*. According to some aspects, the breadth dimension $\Delta B_S$ of the sole transition region 230 at the heel-side end 230*a* may be less than or equal to approximately 50%, approximately 30% or even approximately 20% of the maximum breadth (B) of the club head 14.

According to other aspects, the breadth dimension $\Delta B_S$ of the sole transition region 230 may decrease along its length from the heel-side end 130*a* to the toe-side end 230*b*. According to some embodiments, the breadth dimension $\Delta B_S$ of the sole transition region 230 at the toe-side end 130*b* may be less than or equal to approximately 50%, approximately 30% or even approximately 20% of the maximum breadth (B) of the club head 14. According to even other embodiments, the breadth dimension $\Delta B_S$ of the sole transition region 230 may be generally constant along its length from the heel-side end 230*a* to the toe-side end 230*b*. The maximum breadth dimension of the sole transition region 230 may range from approximately 5 to approximately 30 mm. Alternatively, the maximum breadth dimension of the sole transition region 230 may be less than or equal to 20 mm.

In certain embodiments, the sole transition region 230 need not extend completely across the sole 28 from the heel-side 24 to the toe-side 20. Thus, for example, at its toe-side end 230*b* the sole transition region 230 may smoothly merge into the substantially horizontally-oriented surface of the sole 28. Beyond the toe-side end 230*b*, the sole 28 adjacent to the toe 20 may be configured without any transition region formed between the forward sole region 220 and the rearward sole region 210. According to this aspect, beyond the toe-side end 230*b* of the sole transition region 230, the surface of the sole 28 forms a smooth convex surface devoid of any transition features and having a slope less than 1.0. In particular, the surface of the sole 28 beyond the toe-side end 230*b* of the sole transition region 230 may be free of any inflection points and may be free of any forward and/or rearward sole transition features. Similarly, to the heel side of the heel-side end 230*a*, the surface of the sole 28 may be configured without any transition region formed between the forward sole region 220 and the rearward sole region 210. According to even other embodiments, the sole transition region 230 may extend all the way across the sole 28. In these particular embodiments, the sole transition region 230 extends from a heel-to-sole transition feature to a toe-to-sole transition feature, i.e., where the surfaces of the substantially vertically-oriented surfaces transition at an angle of 45 degrees to the substantially horizontally-oriented sole surface.

Similar to the corresponding features of the crown transition region 130, the sole transition region 230 may be angled toward the rear 22 and away from the front plane as it extends away from the heel 24. For example, the transition region 230 may be generally oriented substantially parallel to the front plane or at a relatively shallow angle from the front plane. Optionally, the sole transition region 230 may be generally oriented at an angle greater than 10° from the front plane or even at an angle greater than 20° from the front plane. Thus, according to certain aspects, the sole transition region 230 may be angled from approximately 0° to approximately 30° from the front plane. Other preferred orientations of the transition region 230 may be at an angle from approximately 0° to approximately 20°, at an angle from approximately 5° to approximately 20°, or even at an angle from approximately 5° to approximately 15° from the front plane.

As best shown in FIG. 17, when viewed from a perpendicular to the centerline of the club head 14 (i.e., when viewed from the side of the club head 14), the surface profile of the sole transition region 230 may be described as being generally "S-shaped." This S-shape surface profile is due to the presence of an inflection point 230*c*. By way of a non-limiting example, a majority of the surface of the sole transition region 230 may have a convex surface profile. On the other side of the inflection point 230*c*, the sole transition region 230 may have a concave surface profile. In some embodiments, a majority of the surface of the sole transition region 230 may have a concave surface profile. As another option, a majority of the surface of the transition region 230 may have a relatively planar surface profile.

Thus it can be seen, given the benefit of this disclosure, that the crown transition region 130 essentially separates or decouples the curvature of the surface of the forward crown region 120 from the curvature of the surface of the rearward crown region 110 and that the sole transition region 230 essentially separates or decouples the curvature of the surface of the forward sole region 220 from the curvature of the surface of the rearward sole region 210. In other words, to a certain extent, the curvature characteristics of the surface of the forward crown region 120 (and/or the forward sole region 220) may be developed without consideration of the curvature characteristics being developed for the surface of the rearward crown region 110 (and/or the rearward sole region 210). This offers the club head designer greater flexibility when shaping the surfaces of the crown 18 and/or the sole 28 and incorporating or developing aerodynamic features.

When the club head 14 is viewed from the heel-side, it can be seen that the forward region of the club head, by virtue of its larger cross-sectional area, will displace more air than a rear region of the club head. Thus, it is expected that the pressure build-up of the air flowing over the club head 14 in the forward region will be greater than the pressure build-up of the air flowing over the club head 14 in the rear region. By stepping down or lowering the crown (and/or the sole) in the rearward region of the club head 14, the aerodynamic profile of the club head, especially when the heel 24 and/or hosel region 26 of the club head 14 are leading the swing, will be reduced.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A golf club head for a metal wood type club, the club head comprising:

a body member including a ball striking face, a heel, a toe, a rear, and a crown, the crown including:

a substantially horizontally-oriented forward crown region extending rearwardly from the ball striking face;

a substantially horizontally-oriented rearward crown region extending forwardly from the rear, the rearward crown region having a smaller height dimension than the forward crown region; and a substantially vertically-oriented crown transition region extending generally in a heel-to-toe direction between the forward crown region and the rearward crown region, wherein the slope of the crown transition region decreases monotonically as the crown transition region extends from the heel toward the toe.

2. The golf club head of claim 1, wherein the forward crown region includes a portion that includes a convexly-curved surface, as viewed from a side of the club head.

3. The golf club head of claim 1, wherein a forward crown transition feature is formed by the intersection of the substantially horizontally-oriented forward crown region with the substantially vertically-oriented crown transition region, and wherein a tangent to the forward crown transition feature, measured at a centerline of the club head, ranges from approximately 0 degrees to approximately 25 degrees from a front plane of the club head.

4. The golf club head of claim 1, wherein a rearward crown transition feature is formed by the intersection of the substantially horizontally-oriented rearward crown region with the substantially vertically-oriented crown transition region, and wherein a tangent to the rearward crown transition feature, measured at a centerline of the club head, ranges from approximately 10 degrees to approximately 35 degrees from a front plane of the club head.

5. The golf club head of claim 1, wherein the centerline breadth of the forward crown region ranges from approximately 25 mm to 50 mm.

6. The golf club head of claim 1, wherein the centerline breadth of the rearward crown region ranges from approximately 30 mm to 60 mm.

7. The golf club head of claim 1, wherein the rearward crown region includes a portion that includes a convexly-curved surface, as viewed from a side of the club head.

8. The golf club head of claim 1, wherein the crown transition region has a centerline breadth that is between approximately 10% and approximately 25% of the breadth of the club head.

9. The golf club head of claim 1, wherein the slope of the crown transition region, measured at a centerline of the club head, ranges from approximately 40% to approximately 70% of the maximum slope of the crown transition region.

10. The golf club head of claim 1, wherein a height dimension of the rearward crown region, as measured at the rearward crown transition feature at a centerline of the club head, ranges from approximately 50% to approximately 80% of the height of the club head.

11. The golf club head of claim 1, wherein the height dimension of the rearward crown region, measured from the heel to the toe along a line located at 60% of the breadth of the club head from the front plane, varies by less than ±20% from the height dimension of the rearward crown region measured at 60% of the breadth of the club head at the centerline of the club head.

12. The golf club head of claim 1, wherein the club head breadth is greater than or equal to 12.0 cm, and the club head length is greater than or equal to 12.0 cm.

13. The golf club head of claim 1, wherein the height of the center of gravity of the club head is less than or equal to 1.75 cm.

14. The golf club head of claim 1, wherein the body member is a square head member.

15. A golf club head for a metal wood type club, the club head comprising:

a body member including a ball striking face, a heel, a toe, a rear, and a crown, the crown including:

a forward crown region extending rearwardly from the ball striking face;

a rearward crown region extending forwardly from the rear, the rearward crown region having a smaller height dimension than the forward crown region, wherein a difference between a height of the rearward crown region and a height of the forward crown region is 5 mm to 30 mm; and an elongated crown transition region extending between the forward crown region and the rearward crown region and generally extending in a heel-to-toe direction at an angle that ranges from approximately 5 degrees to approximately 40 degrees from a front plane of the club head, wherein the elongated crown transition region has a slope that decreases monotonically as the crown transition region extends from the heel toward the toe.

16. The golf club head of claim 15, wherein a majority of the surface of the rearward crown region is a substantially convexly-curved surface.

17. The golf club head of claim 15, wherein the maximum height dimension of the rearward crown region is less than the minimum height dimension of the forward crown region.

18. The golf club head of claim 15, wherein the crown transition region is located within the middle 50% of the breadth of the club head.

* * * * *